US005835120A

United States Patent [19]

Hamano et al.

[11] Patent Number: 5,835,120

[45] Date of Patent: Nov. 10, 1998

[54] DOUBLE-RESOLUTION OPTICAL SYSTEM FOR ELECTROPHOTOGRAPHIC PRINTER

[75] Inventors: Hiroshi Hamano; Hiroshi Furuya; Hiroshi Tohyama; Hiromasa Kanno; Shigeki Ogura; Yuji Terouchi, all of Tokyo, Japan

[73] Assignee: Oki Electric Industry Co., Ltd., Tokyo, Japan

[21] Appl. No.: 542,063

[22] Filed: Oct. 12, 1995

[30] Foreign Application Priority Data

Oct. 25, 1994 [JP] Japan ..... 6-260431
Mar. 8, 1995 [JP] Japan ..... 7-048049

[51] Int. Cl.[6] ..... B41J 2/47; B41J 2/45

[52] U.S. Cl. ..... 347/241; 347/238; 347/239; 347/134

[58] Field of Search ..... 347/238, 136, 347/241, 239, 134

[56] References Cited

U.S. PATENT DOCUMENTS

| | | | |
|---|---|---|---|
| 4,367,924 | 1/1983 | Clark et al. | 349/37 |
| 4,614,954 | 9/1986 | Ohta et al. | 347/224 |
| 4,634,226 | 1/1987 | Isogai et al. | 345/96 |
| 4,721,977 | 1/1988 | Fukae . | |
| 4,743,800 | 5/1988 | Mimura et al. | 313/497 |
| 5,251,057 | 10/1993 | Guerin et al. | 359/249 |
| 5,515,097 | 5/1996 | Munechika et al. | 347/241 |

FOREIGN PATENT DOCUMENTS

| | | |
|---|---|---|
| 03 144545A | 6/1991 | Japan . |
| 06 024039A | 2/1994 | Japan . |
| 6-24039 | 2/1994 | Japan . |
| 06 268948A | 12/1994 | Japan . |

OTHER PUBLICATIONS

"LED Array Development and Printer Development" Torikeppusu WS 6 (Oct. 1985), pp. 114–140.

*Primary Examiner*—David F. Yockey
*Attorney, Agent, or Firm*—Spencer & Frank

[57] ABSTRACT

Light emitted from an array of light-emitting elements in an electrophotographic printer is transmitted through a birefringent plate that deflects light polarized in a first plane but does not deflect light polarized in a second plane perpendicular to the first plane, and through a polarization switching device that is controlled by an electrical signal so as to selectably transmit light polarized in either the first plane or the second plane. The transmitted light illuminates a photosensitive medium. Each light-emitting element can illuminate two dots on the photosensitive medium, depending on the state of the polarization switching device, thereby doubling the dot resolution.

17 Claims, 26 Drawing Sheets

DOUBLE-RESOLUTION OPTICAL SYSTEM FOR ELECTROPHOTOGRAPHIC PRINTER

BACKGROUND OF THE INVENTION

The present invention relates to the optical system of an electrophotographic printer, more particularly to an optical system that doubles the resolution of a linear array of light-emitting elements.

One type of printer in which the invention can be usefully employed has an array of light-emitting diodes (LEDs). Responding to print data, the diodes illuminate an electrically charged photosensitive drum, forming a line of electrostatic dots. The drum turns so that dot lines are illuminated one after another, building up an electrostatic image, which is developed by application of toner and transferred to paper.

In a conventional LED printer, the dot resolution of the image printed on the paper is equal to the spacing of the light-emitting diodes in the array. If there are three hundred light-emitting diodes per inch, for example, then the printed image will have a resolution of three hundred dots per inch (DPI).

Since higher resolutions give better printed image quality, there is a desire to build LED printers with the highest possible dot resolution. LED printers with resolutions exceeding three hundred DPI have in fact been built, but not without certain difficulties. These include the difficulty of fabricating LED array semiconductor devices with sufficient dimensional accuracy; the difficulty of accurately assembling a plurality of these LED array semiconductor devices into a single array with a uniform spacing; the particular difficulty of maintaining uniformity of the array at the points where one LED array semiconductor device abuts against another; and the difficulty of coupling the LED array semiconductor devices to their driver circuits, which typically requires very-high-density wire bonding. These difficulties make very high dot resolutions unattainable, and tend to make the achievement of even moderately high dot resolutions an expensive proposition.

A known method of alleviating these difficulties is to insert a liquid crystal ell between the LED array and the photosensitive drum, tilted at an angle to both. At one end, the liquid crystal cell is relatively close to the LED array and relatively far from the photosensitive drum; at the other end, the liquid crystal cell is relatively far from the LED array and relatively close to the photosensitive drum. Due to the tilt, as light passes through the liquid crystal cell, the light path is deflected by a certain amount in the longitudinal direction of the array. The width of the deflection depends on the refractive index of the liquid crystal cell, which can be controlled by an applied electrical signal. By switching this electrical signal between two values, each light-emitting element can be made to produce two dots, thereby doubling the dot resolution of the printer.

The tilt of the liquid crystal cell, however, imposes certain restrictions on the printer design. In particular, to accommodate the tilt, a large space must be provided between the LED array and the photosensitive drum. Focusing elements must also be accommodated in this space, but the tilted liquid crystal cell forces the focusing elements to be distant from either the LED array or the photosensitive drum. These design restrictions limit the applicability of the above method.

SUMMARY OF THE INVENTION

It is therefore an object of the present invention to provide a compact optical system for doubling the resolution of an electrophotographic printer employing an array of light-emitting elements.

According to a first aspect of the invention, the optical system comprises a polarizer, a polarization rotation switch, and a birefringent plate. The polarization rotation switch is disposed between the polarizer and the birefringent plate. The polarizer transmits light that is linearly polarized in a first plane, and blocks light that is linearly polarized in a second plane perpendicular to the first plane. The birefringent plate has a principal plane that is parallel to one of these two planes, either the first plane or the second plane. The birefringent plate transmits light polarized in the principal plane with a deflection in the principal plane, and transmits light polarized in a plane perpendicular to the principal plane without deflection. The polarization rotation switch rotates the plane of polarization of incident light responsive to an electrical signal: when the electrical signal is in one state, light polarized in the first plane becomes polarized in the second plane, and light polarized in the second plane becomes polarized in the first plane; when the electrical signal is in another state, no such switching between the first and second polarization planes occurs.

According to a second aspect of the invention, the optical system comprises a birefringent plate, and a polarization switch controlled by an electrical signal. When the electrical signal is in one state, the polarization switch transmits light polarized in a first plane and blocks light polarized in a second plane perpendicular to the first plane; when the electrical signal is in a second state, the polarization switch blocks light polarized in the first plane and transmits light polarized in the second plane. The birefringent plate has a principal plane that is parallel to the first plane, so it transmits light polarized in the first plane with a deflection in the first plane, and transmits light polarized in the second plane without deflection.

In both aspects of the invention, the optical system is disposed between an array of light-emitting elements and a photosensitive medium, parallel to both the array and the medium. The optical system may also include a lens array for focusing the light.

DETAILED DESCRIPTION OF THE INVENTION

Embodiments of the invention will be described below with reference to the illustrative drawings. These drawings are schematic and are not necessarily drawn accurately to scale. The first fourteen embodiments illustrate the first aspect of the invention; the other embodiments illustrate the second aspect.

Figure 1:
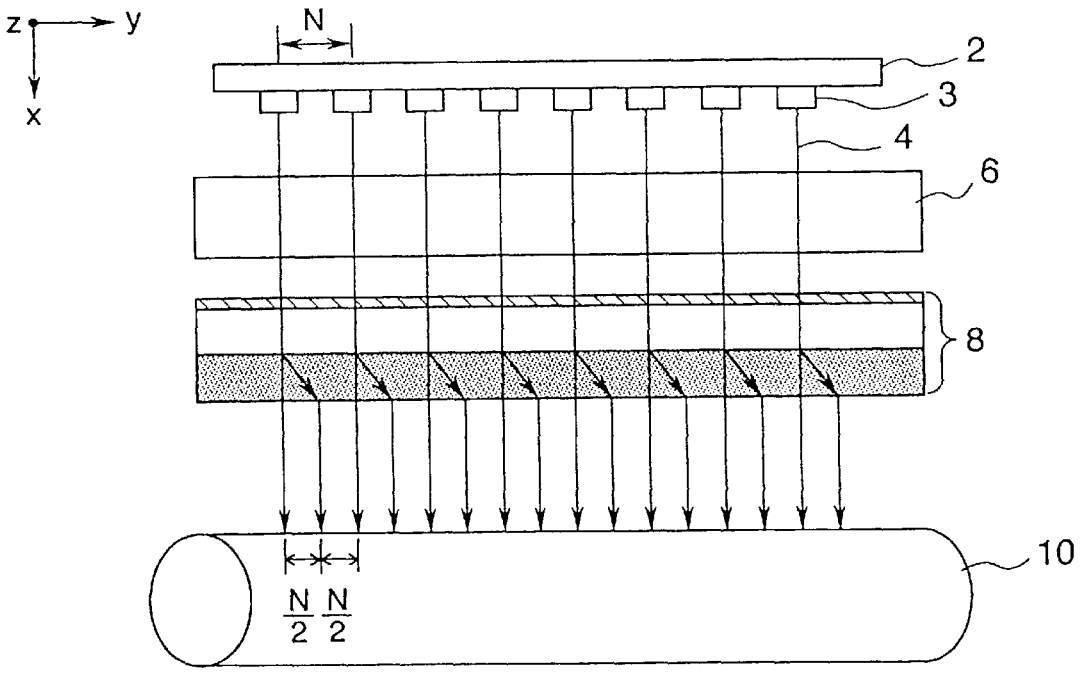
FIG. 1 is a schematic drawing of a first embodiment, illustrating the first aspect of the invention.

Referring to FIG. 1, the invention is used in a printer having a fixed, linear array 2 of light-emitting elements 3. The light-emitting elements 3 in the linear array 2 may be light-emitting diodes or any other suitable light-emitting elements. They are disposed at a uniform spacing, the spacing being denoted in the drawing by the letter N. No particular restriction is placed on the value of N, but one example of interest is 42.3 micrometers (N=42.3 $\mu$m), providing six hundred light-emitting elements per inch. Another typical example is N=84.6 $\mu$m, providing three hundred light-emitting elements per inch.

The light-emitting elements 3 emit light 4 which is focused by a lens array 6. The lenses in the lens array 6 are convergent rod lenses with graded indexes of refraction. The light 4 is focused to equal-sized erect images with a magnification ratio of 1×, forming illuminated dots. No restriction is placed on the wavelength of the emitted light 4, but a typical wavelength is seven hundred twenty nanometers (720 nm).

After being focused by the lens array 6, the light 4 passes through a dot-doubling device 8. This device operates in two states: in one state, the light 4 is transmitted straight through; in the other state the light 4 is deflected. Both sets of light paths are indicated by arrows in the drawing. The width of the deflection is N/2.

The light that emerges from the dot-doubling device 8 illuminates a photosensitive drum 10. If the dots illuminated in the two states described above are taken together, they form a line of dots spaced at intervals of N/2 on the photosensitive drum 10.

The direction of propagation of the light 4 will be referred to as the x-direction. The longitudinal direction of the linear array 2, which is perpendicular to the x-direction, is denoted as the y-direction. The y-direction is sometimes referred to as the main scanning direction. The y-direction is also the direction of the deflection produced in the dot-doubling device 8. The direction perpendicular to both the x- and y-directions is the z-direction, which is sometimes referred to as the sub-scanning direction. The x-, y-, and z-directions will be indicated in the drawings by arrows and black dots, a black dot denoting the direction perpendicular to the drawing sheet.

Planes aligned with these three directions will also be referred to by the letters x, y, and z. Any plane perpendicular to the z-direction will be referred to as an x-y plane, any plane perpendicular to the y-direction as an x-z plane, and any plane perpendicular to the x-direction as a y-z plane. Light will be described as being polarized in the x-y plane or x-z plane.

Figure 2:
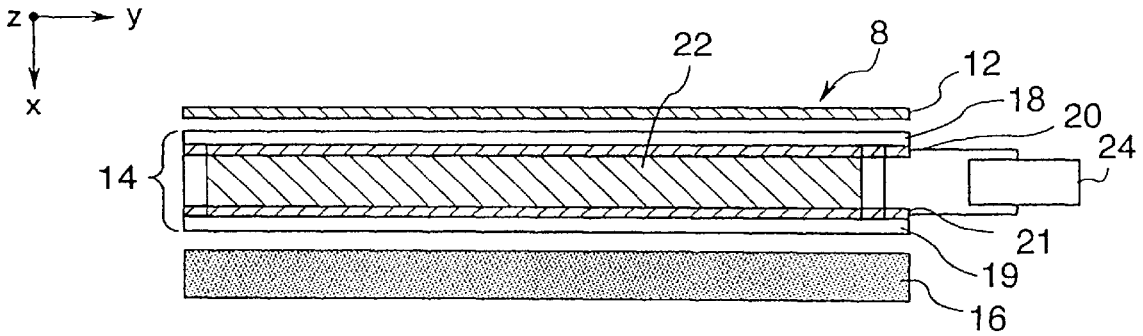
FIG. 2 is a more detailed drawing of the dot-doubling device in the first embodiment.

FIG. 2 shows an enlarged view of the dot-doubling device 8, which comprises a polarizer 12, a ferroelectric liquid crystal cell 14, and a birefringent plate 16. The polarizer 12 transmits light polarized in the x-z plane, and blocks light polarized in the x-y plane. The birefringent plate 16 deflects light polarized in the x-y plane.

The ferroelectric liquid crystal cell 14 comprises a pair of parallel glass plates 18 and 19 with transparent electrodes 20 and 21 formed on their facing surfaces, arid a ferroelectric liquid crystal 22 confined between the transparent electrodes 20 and 21. The transparent electrodes 20 and 21 can be made of indium-tin-oxide (ITO), for example. The facing surfaces of the glass plates 18 and 19, and of the transparent electrodes 20 and 21, are processed so as to provide anchoring surfaces for the liquid crystal molecules. A driving circuit 24 furnishes electrical signals to the transparent electrodes 20 and 21.

These electrical signals create an electrical field E in the space between the transparent electrode 20 and 21. The polarity of this field can be reversed, e.g. by reversing the connections of the electrical signals to the transparent electrodes 20 and 21. The electrical field F controls the alignment of the liquid crystal molecules.

Figure 3:
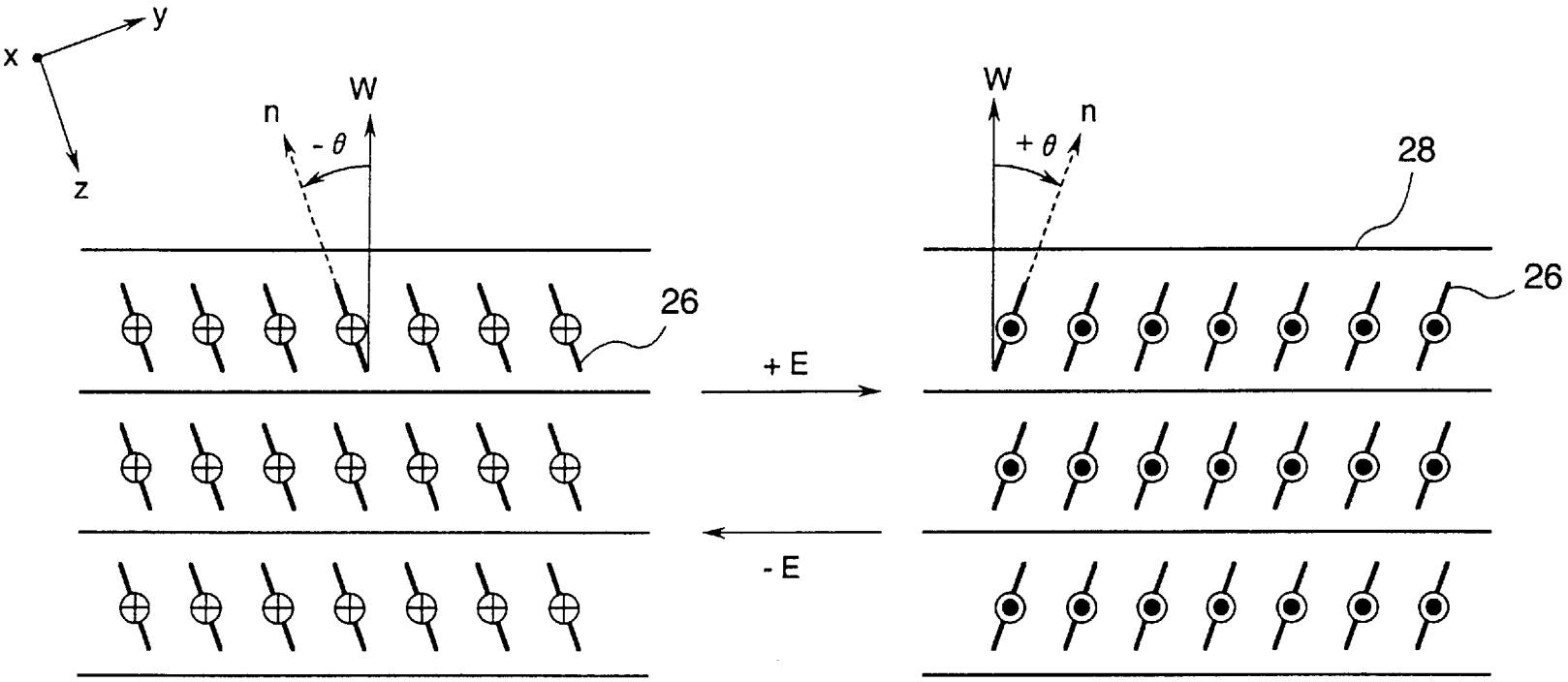
FIG. 3 illustrates the response of the ferroelectric liquid crystal cell in FIG. 1 to an applied electric field.

Referring to FIG. 3, the liquid crystal phase is the so-called chiral smectic C phase, in which the liquid crystal molecules 26 are aligned in smectic layers 28 but are prevented by the narrow space in which the liquid crystal is confined from assuming their natural spiral form. Instead, the liquid crystal molecules 26 have an elongate form, with their long axes aligned in a certain direction n. This direction n, referred to as the director of the liquid crystal, is tilted at an angle θ to the normal direction W of the smectic layers 28. In the first embodiment the tilt angle θ is 22.5°. Switching the polarity of the applied electric field between +E and −E switches the director between angles of +θ and −θ.

The liquid crystal in the first embodiment is anchored so that when the applied electric field is −E, the director n is aligned in the z-direction, parallel to the x-z plane and perpendicular to the x-y plane. When the applied electric field is +E, the director n is accordingly inclined at an angle of 2θ or 45° to the z-direction, and is at a 45° angle to both the x-y plane and the x-z plane.

Figure 4:
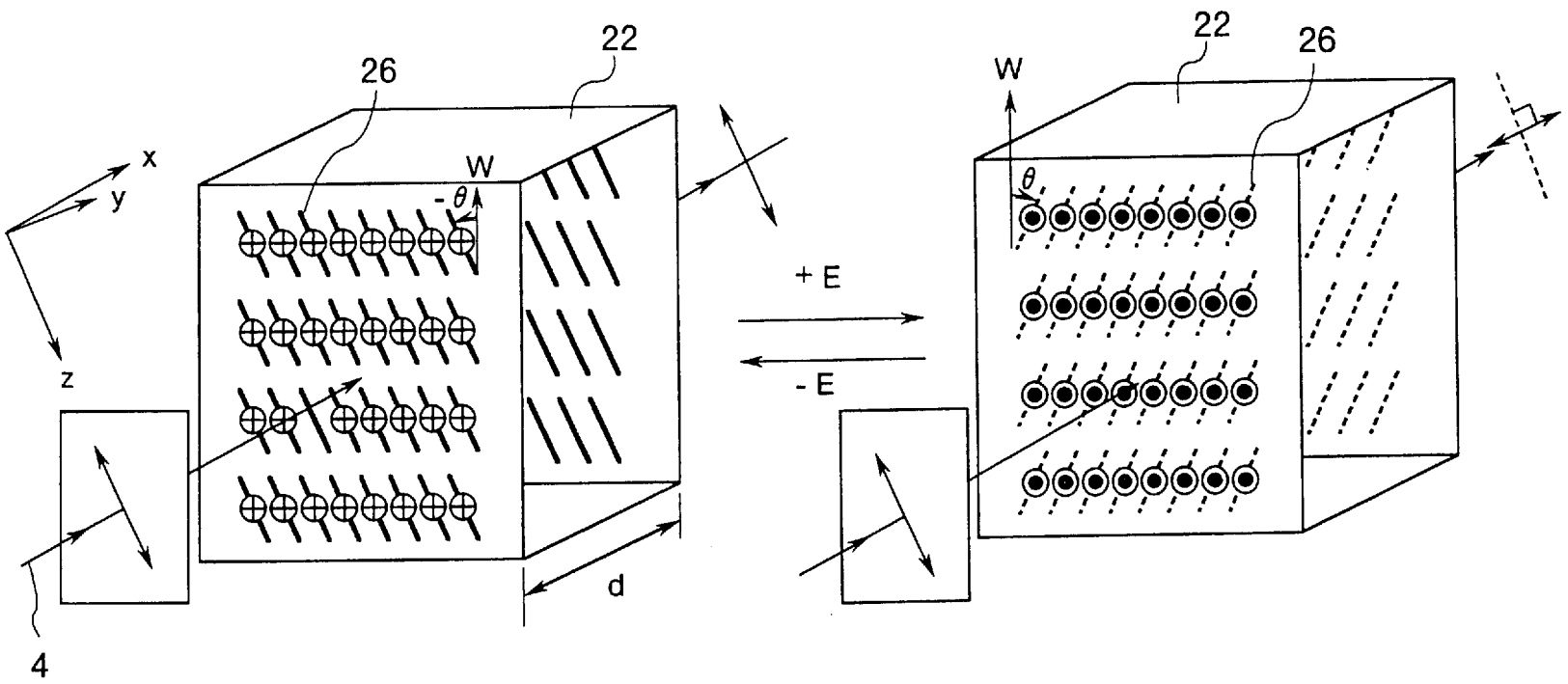
FIG. 4 illustrates selective rotation of the plane of polarization of light by the ferroelectric liquid crystal cell in FIG. 1.

FIG. 4 shows the effect of the ferroelectric liquid crystal 22 on incident light 4 propagating in the x-direction and polarized in the x-z plane. When the director of the ferroelectric liquid crystal 22 is aligned in the z-direction due to application of a −E electric field, the light passes through the ferroelectric liquid crystal 22 with no rotation of its plane of polarization. When the director of the ferroelectric liquid crystal 22 is aligned at a 45° angle to the z-axis due to application of a +E electric field, however, the plane of polarization of the light is rotated through an angle that depends on the thickness d of the ferroelectric liquid crystal 22. In the first embodiment the thickness d is selected in relation to the wavelength of the light 4 so as to make the ferroelectric liquid crystal 22 act as a half-wave plate, rotating the plane of polarization through a right angle, as shown. The incident light 4 which was polarized in the x-z plane thus emerges polarized in the x-y plane.

Although not shown in the drawing, incident light polarized in the x-y plane is similarly affected. When the liquid crystal molecules 26 are aligned in the z-direction by application of a −E electric field, the light passes through the ferroelectric liquid crystal 22 without rotation of its plane of polarization. When the liquid crystal molecules 26 are aligned at a 45° angle to the y- and z-directions by application of a +E electric field, however, the plane of polarization is rotated by 90° and the light emerges polarized in the x-z plane instead of in the x-y plane.

In both cases the rotation results from the different propagation delays experienced by light polarized parallel to the director of the liquid crystal 22 and light polarized perpendicular to the director. Light polarized at a 45° angle to the director can be considered to consist of equal proportions of these two components.

The ferroelectric liquid crystal cell 14 thus acts as a polarization rotation switch, interchanging the x-y and x-z planes of polarization of light when an applied electric signal is in one state, and leaving these planes of polarization unaltered when the applied electric signal is in another state.

Figure 5:
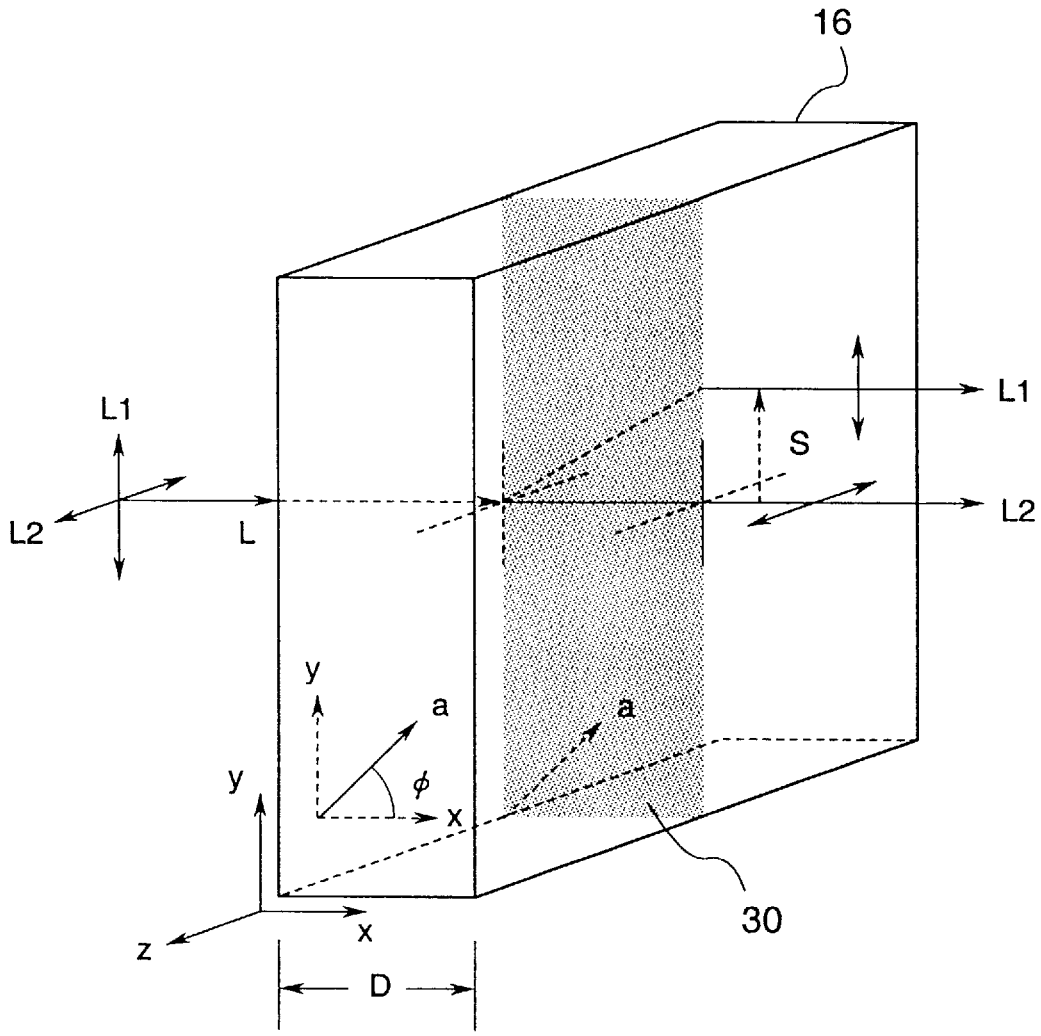
FIG. 5 illustrates selective deflection of light by a birefringent plate.

FIG. 5 illustrates the effect of the birefringent plate 16 on polarized light. The birefringent plate 16 is a parallel plate mounted so that its surfaces are perpendicular to the x-direction and parallel to the y-z plane. The birefringent plate 16 is cut so that its optic axis (a) is disposed in the x-y plane but does not coincide with the x- or y-direction, there being an angle ϕ between the optic axis (a) and x-direction.

The birefringent plate 16 therefore has a principal plane 30 which, in the first embodiment, is parallel to the x-y plane, hence to the longitudinal axis of the linear array 2. Due to the birefringent properties of the birefringent plate 16, incident light $L_1$ propagating in the x-direction and polarized in the x-y plane is deflected in the y-direction as it passes through the birefringent plate 16. The size S of the deflection depends on the angle ϕ and the thickness D of the birefringent plate 16.

Figure 6:
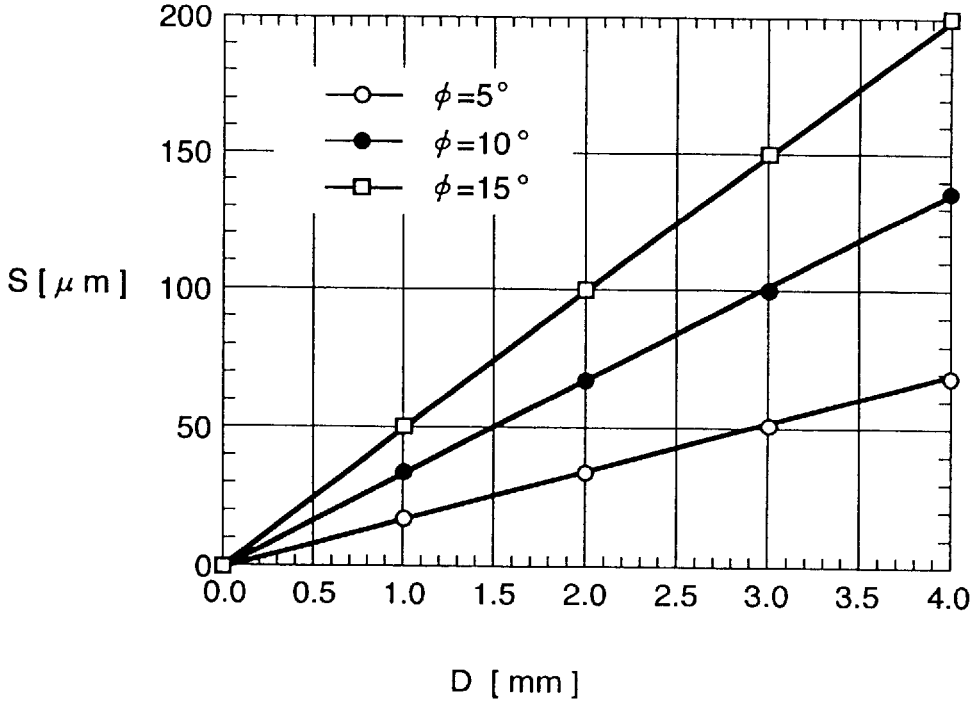
FIG. 6 is a graph illustrating deflection as a function of the thickness of the birefringent plate.

FIG. 6 shows the dependence of the deflection S on the thickness D of a calcite birefringent plate 16 when the angle ϕ is 5°, 10°, and 15°. The thickness D is indicated in millimeters (mm) on the horizontal axis. The deflection S is indicated in micrometers (μm) on the vertical axis. The dependence is linear: for a given angle ϕ, the deflection S is proportional to the thickness D.

Figure 7:
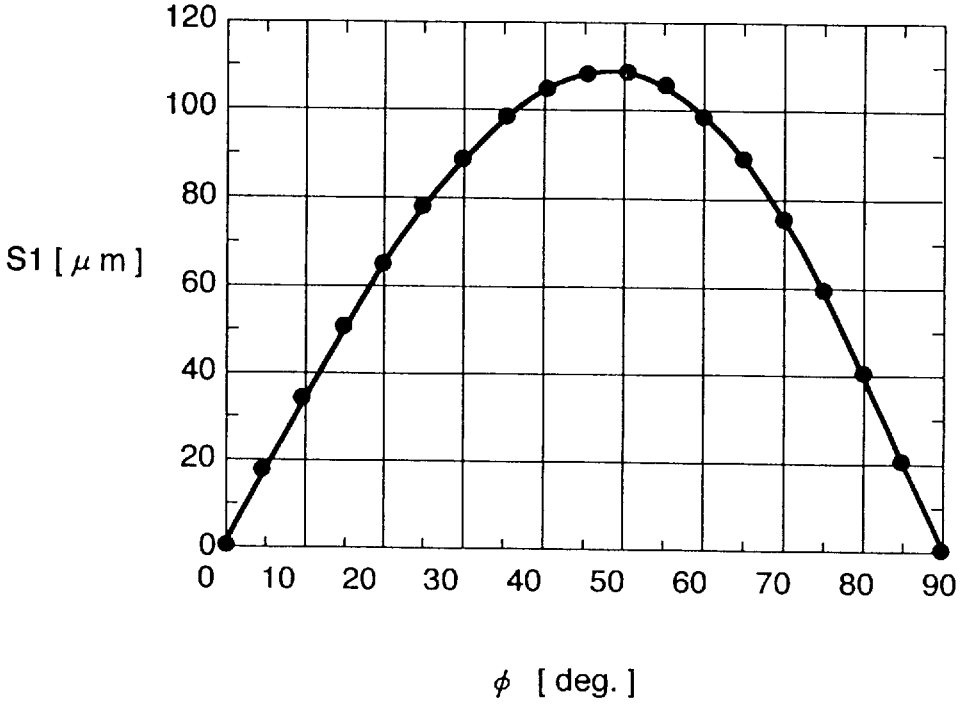
FIG. 7 is a graph illustrating deflection per unit thickness of the birefringent plate as a function of the angle between the optic axis and and normal axis of the birefringent plate.

FIG. 7 shows the constant of proportionality S1 as a function of the angle ϕ between the optic axis (a) and the x-direction. The angle ϕ is indicated in degrees on the horizontal axis. S1 is indicated in micrometers per millimeter on the vertical axis. The vertical axis thus indicates the deflection that would be produced by a birefringent plate 16 one millimeter thick.

The deflection can be calculated from the following equations, in which the symbol $n_e$ denotes the extraordinary refractive index of the birefringent plate 16 (the refractive index in the direction of the optic axis), and $n_o$ denotes the ordinary refractive index (in a direction perpendicular to the optic axis). S, D, and ϕ have the meanings given above.

$$a=1/n_e$$

$$b=1/n_o$$

$$c^2=a^2\sin^2\phi+b^2\cos^2\phi$$

$$S=\{[D(b^2-a^2)]/(2c^2)\}\sin(2\phi)$$

If the wavelength of the incident light is 720 nm, the refractive indexes of calcite are $n_e$=1.65 and $n_o$=1.48. If the spacing N of the light-emitting elements 3 is 42.3 μm, then from the equations above, the desired displacement of N/2 or 21.15 μm can be obtained by cutting a calcite birefringent plate 16 to a thickness of 1.24 mm with an angle $\phi$ of 5° between the optic axis and the normal axis of the plate (the x-direction in the drawings).

Next the operation of the first embodiment will be described with reference to FIGS. 8A and 8B. In these drawings, light polarized in the x-y plane (the plane of the drawing sheet) will be denoted by a horizontal double-headed arrow, and light polarized in the x-z plane (perpendicular to the drawing sheet) will be denoted by a black dot. Natural light, which is not polarized in any one plane, will be denoted by superimposing the double-headed arrow and black dot symbols. The spacing between light-emitting elements 3 will be 42.3 $\mu$m. The dots in one line of print data will be assumed to be numbered from left to right, starting from dot number one.

To print a line of dots, first the driving circuit 24 in FIG. 2 is controlled so as to place a −E electric field across the ferroelectric liquid crystal cell 14. This field aligns the liquid crystal molecules 26 of the ferroelectric liquid crystal 22 in the x-z plane, in the state shown on the left in FIGS. 3 and 4. Once aligned, a ferroelectric liquid crystal maintains its alignment even in the absence of an electric field, so the field can be switched off.

Figure 8B:
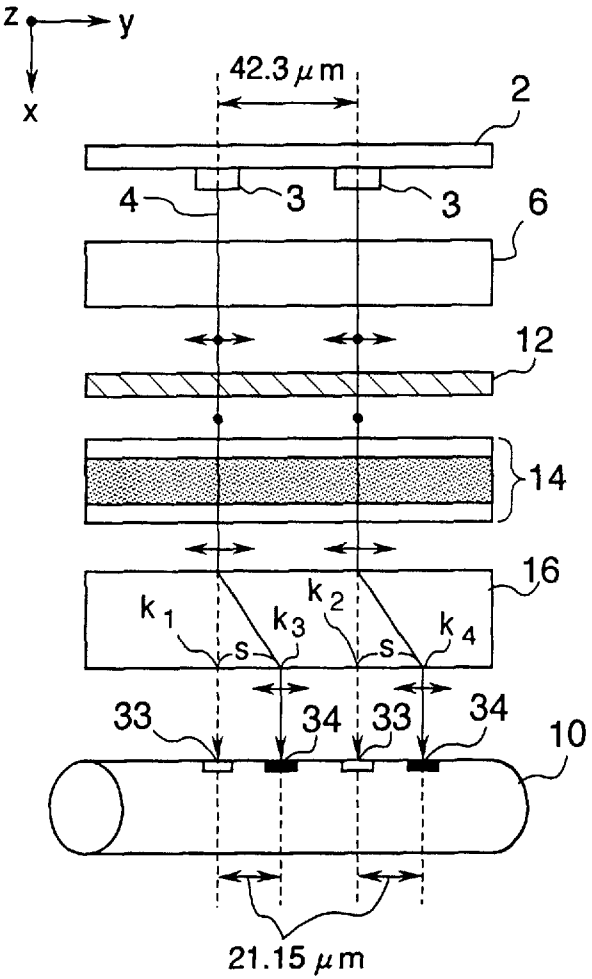
FIG. 8B illustrates the operation of the first embodiment in a second state.
Figure 8A:
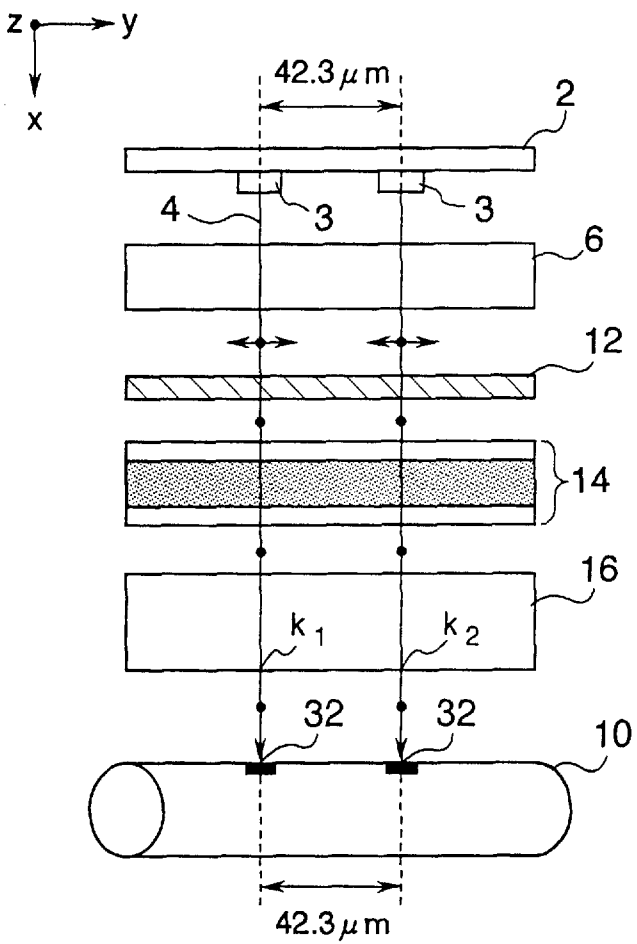
FIG. 8A illustrates the operation of the first embodiment in a first state.

Referring to FIG. 8A, the light-emitting elements 3 are now driven according to the odd-numbered data in the line of dots. The light-emitting elements 3 are thus switched on or off according to the first, third, fifth, and other odd-numbered dot data. The light 4 emitted by the light-emitting elements 3 that are switched on is focused by the lens array 6, enters the polarizer 12 as natural light, and emerges as light polarized in the x-z plane. This light passes through the ferroelectric liquid crystal cell 14 with no rotation of its plane of polarization and emerges still polarized in the x-z plane. The light then passes through the birefringent plate 16 with no deflection and emerges at points such as $k_1$ and $k_2$ to illuminate dots 32 on the photosensitive drum 10. These dots 32 are spaced at intervals of 42.3 $\mu$m.

Next, the driving circuit 24 in FIG. 2 is controlled so as to place a +E electric field across the ferroelectric liquid crystal cell 14. This field aligns the liquid crystal molecules 26 of the ferroelectric liquid crystal 22 at a 45° angle to the y- and z-directions, in the state shown on the right in FIGS. 3 and 4. Referring to FIG. 8B, the light-emitting elements 3 are now driven according to the even-numbered dot data, so that they are switched on or off according to the second, fourth, sixth, and other even-numbered dot data. The light 4 emitted by the light-emitting elements 3 that are switched on is again focused by the lens array 6 and polarized by the polarizer 12 in the x-z plane. This time, however, the ferroelectric liquid crystal cell 14 rotates the plane of polarization by 90°, so that the light that enters the birefringent plate 16 is polarized in the x-y plane, which is the principal plane of the birefringent plate 16.

The light is accordingly deflected by the amount S and emerges at points such as $k_3$ and $k_4$ to illuminate dots 34 on the photosensitive drum 10. These dots 34 are located midway between the dots 32 illuminated earlier, so the even-numbered dots are printed midway between the odd-numbered dots, as desired. The interval between odd-numbered and even-numbered between dots is 21.15 $\mu$m.

Next the drum is rotated 21.15 $\mu$m and the same procedure is repeated to print another line of dots. In this way a dot image with a resolution of 21.15 $\mu$m (one thousand two hundred dots per inch) is built up, using a linear array 2 with a resolution of only six hundred dots per inch.

The first embodiment has been described as illuminating the odd-numbered dots first and the even-numbered dots second, but needless to say, it makes no difference whether the even or odd dots are illuminated first.

From FIGS. 8A and 8B it can be seen that the polarizer 12 and ferroelectric liquid crystal cell 14 combine to form a polarization switching device that transmits light polarized in one of two selectable, perpendicular planes. More specifically, the light entering the polarizer 12 is natural light in both drawings, but the light that emerges is polarized in the x-z plane in FIG. 8A, and in the x-y plane in FIG. 8B.

The main effect of the first embodiment is that each light-emitting element 3 can illuminate two dots, thereby refining the dot resolution from 42.3 $\mu$m to 21.15 $\mu$m. A further advantage is that the polarizer 12, ferroelectric liquid crystal cell 14, and birefringent plate 16 all lie parallel to the y-z plane and are not tilted. Both the lens array 6 and the dot-doubling device 8 can accordingly be accommodated in the space between the linear array 2 and the photosensitive drum 10, without making this space unduly large.

The first embodiment as described above uses one of four possible combinations of orientations of the polarizer 12 and ferroelectric liquid crystal cell 14. These four combinations are tabulated in FIG. 9, using a black disc to denote the z-direction, a horizontal double-headed arrow to denote the y-direction, and a diagonal double-headed arrow to denote a direction inclined at a 45° angle to the y- and z-directions. As FIG. 9 indicates, the polarizer 12 may be oriented with its transmission axis in either the y-direction or the z-direction. The ferroelectric liquid crystal cell 14 may be adapted so that the director is switched between the z-direction and the 45° direction, or between the y-direction and the 45° direction.

In the first embodiment, white circle 36 denotes the state in which the director of the liquid crystal is aligned in the z-direction and the odd dot data are used to drive the light-emitting elements 3. White circle 37 denotes the state in which the director is aligned in the 45° direction and the even dot data are used.

Figure 9:
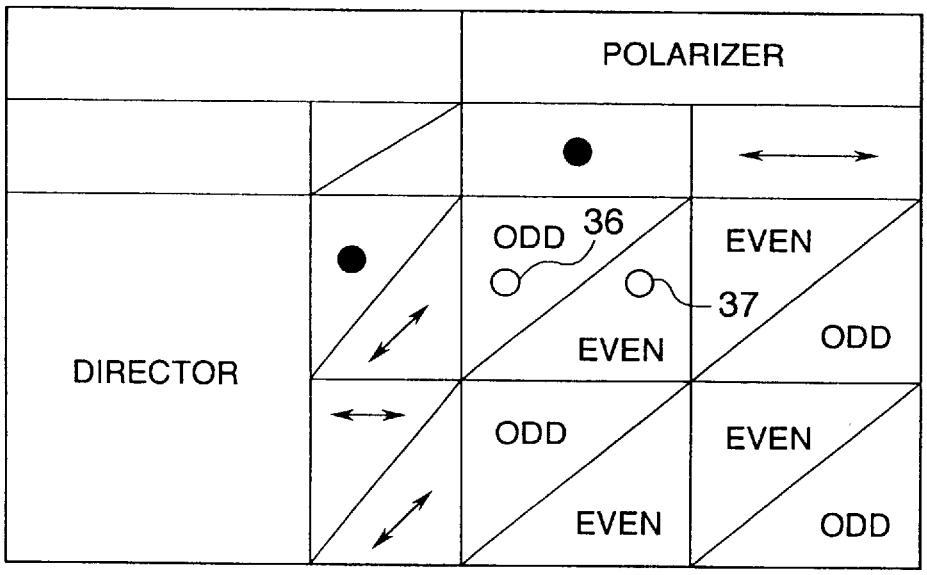
FIG. 9 is a table illustrating various possible combinations of the transmission axis of the polarizer and the director orientations of the ferroelectric liquid crystal cell.

The first embodiment can be varied by employing any of the other three combinations illustrated in FIG. 9. The same result is achieved: a doubling of the dot resolution in the y-direction. If the transmission axis of the polarizer 12 is aligned in the y-direction, then when the light-emitting elements 3 are driven by the odd dot data, the liquid crystal director should be aligned in the 45° direction.

The combination indicated by circles 36 and 37 in FIG. 9 will also be employed in the second to seventh embodiments below, but like the first embodiment, these embodiments can be varied by employing any of the other combinations in FIG. 9.

Figure 10:
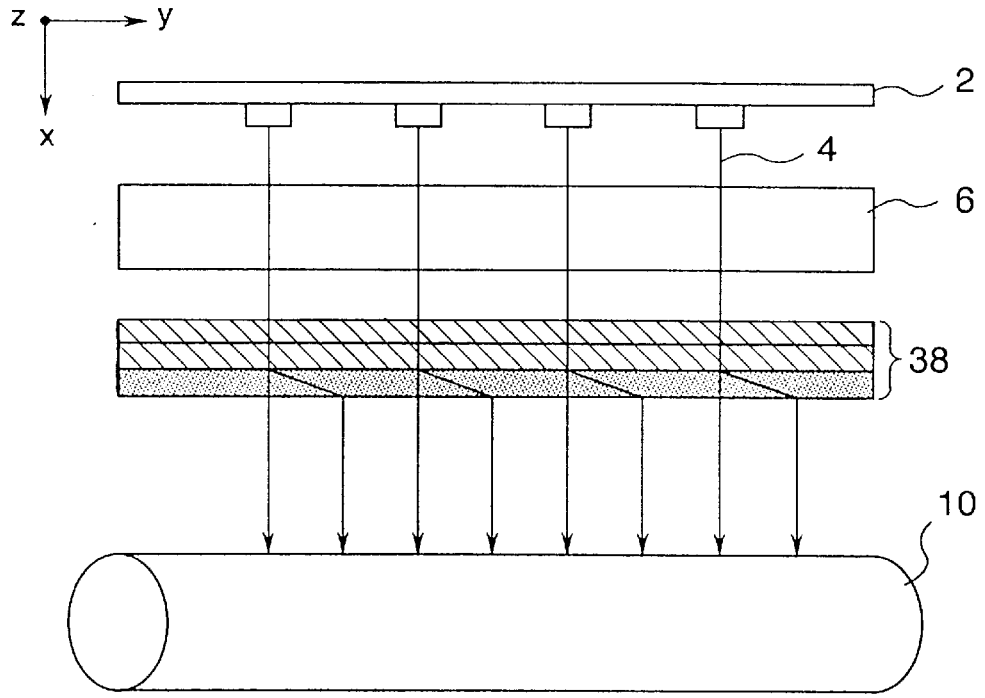
FIG. 10 is a schematic drawing illustrating a second embodiment of the invention.

FIG. 10 illustrates the second embodiment. This embodiment has the same linear array 2, lens array 6, and photosensitive drum 10 as the first embodiment, but a slightly different dot-doubling device 38.

Figure 11:
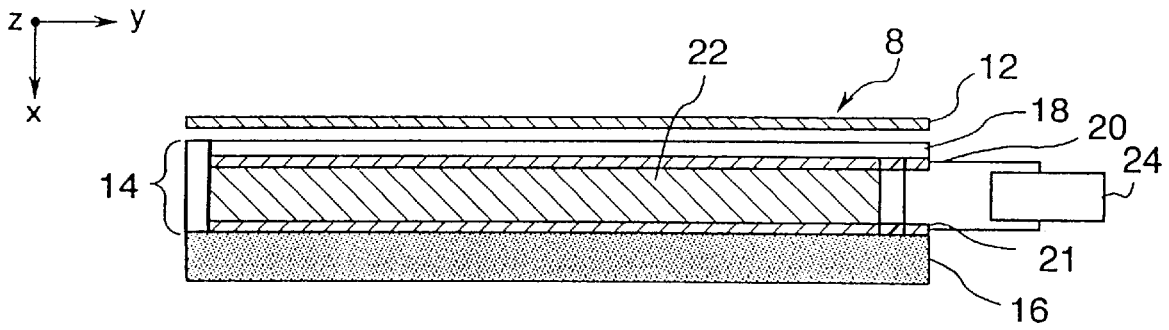
FIG. 11 is a more detailed drawing of the dot-doubling device in the second embodiment.

FIG. 11 illustrates the detailed structure of the dot-doubling device 38 in the second embodiment, using the same reference numerals as in FIG. 2 to denote identical or equivalent elements. The birefringent plate 16 is now placed in direct contact with transparent electrode 21 of the ferroelectric liquid crystal cell 14, thereby eliminating the need for the second glass plate 19 in FIG. 2. That is, the transparent electrode 21 is deposited on one surface of the birefringent plate 16, which serves as one confining wall of the ferroelectric liquid crystal cell 14. The surface of the birefringent plate 16 is processed for alignment of the ferroelectric liquid crystal 22 in the same way that the surface of the glass plate 19 was processed in the first embodiment.

Figure 12B:
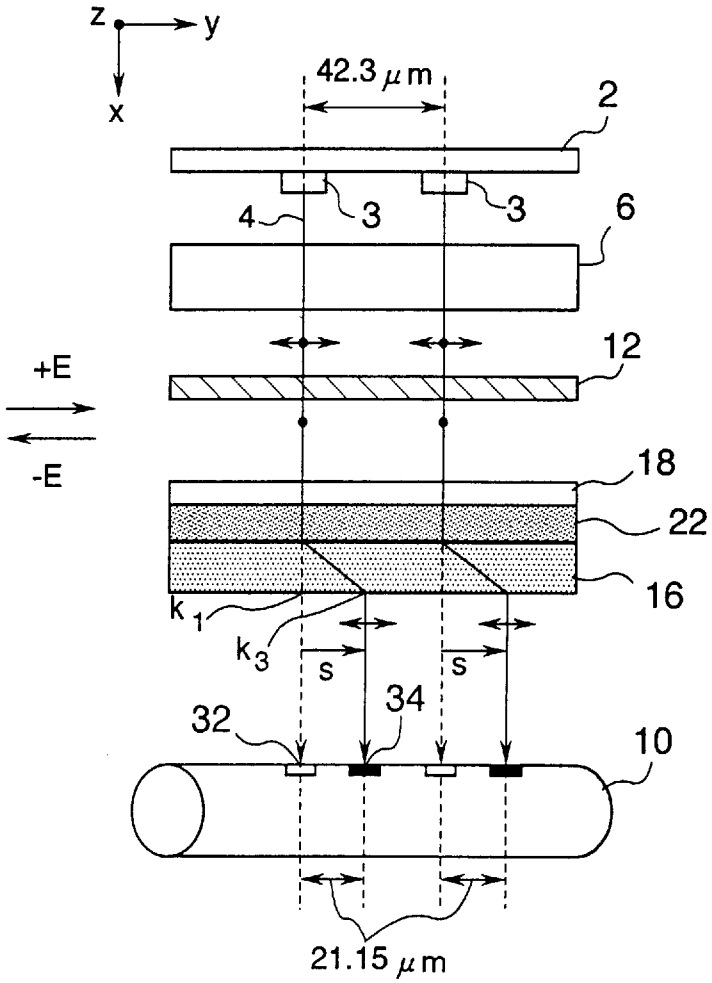
FIG. 12B illustrates the operation of the second embodiment in a second state.
Figure 12A:
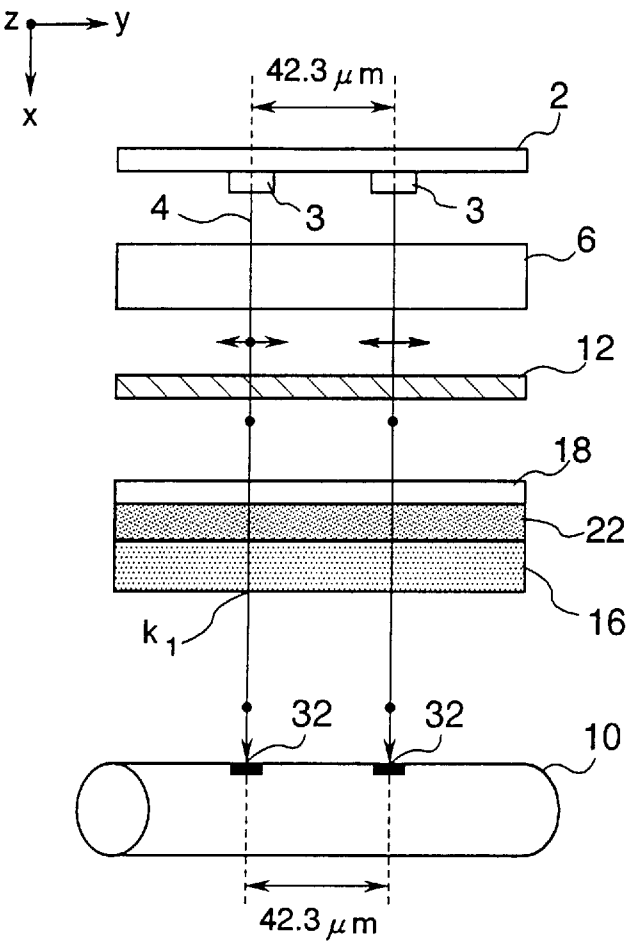
FIG. 12A illustrates the operation of the second embodiment in a first state.

Aside from this difference, the second embodiment is structurally similar to the first embodiment, and the operation is also similar. The operation is illustrated in FIGS. 12A and 12B, using the same reference numerals and notation as FIGS. 8A and 8B. In FIG. 12A, to print odd-numbered dot data, a −E electric field is applied, so that light 4 is transmitted straight through the ferroelectric liquid crystal 22 and birefringent plate 16, without rotation of its plane of polarization. In FIG. 12B, to print even-numbered dots, a +E electric field is applied, so that the plane of polarization of the light 4 is rotated in the ferroelectric liquid crystal 22, and the light paths are deflected by amount an S (21.15 $\mu$m) in the birefringent plate 16.

The second embodiment provides the same advantages as the first embodiment, printing dots with a resolution of one thousand two hundred dots per inch (21.15 $\mu$m) using a linear array 2 with only six hundred light-emitting elements 3 per inch (disposed at intervals of 42.3 $\mu$m). However, the second embodiment also provides two additional advantages.

One additional advantage is that eliminating the glass plate 19 and placing the birefringent plate 16 in direct contact with the transparent electrode 21 makes the dot-doubling device thinner. For the same resolution and angle parameters N and $\phi$ as in the first embodiment, the total thickness of the dot-doubling device 38 in the second embodiment need be no greater than two millimeters. The dot-doubling device 38 can be accommodated easily in the space between the linear array 2 and the photosensitive drum 10 of a typical electrophotographic printer.

A second advantage is that elimination of the glass plate 19 in the second embodiment reduces the number of interfaces at which internal reflection can occur, thus reducing loss of light. The linear array 2 in the second embodiment accordingly requires less driving current than the first embodiment.

Figure 13:
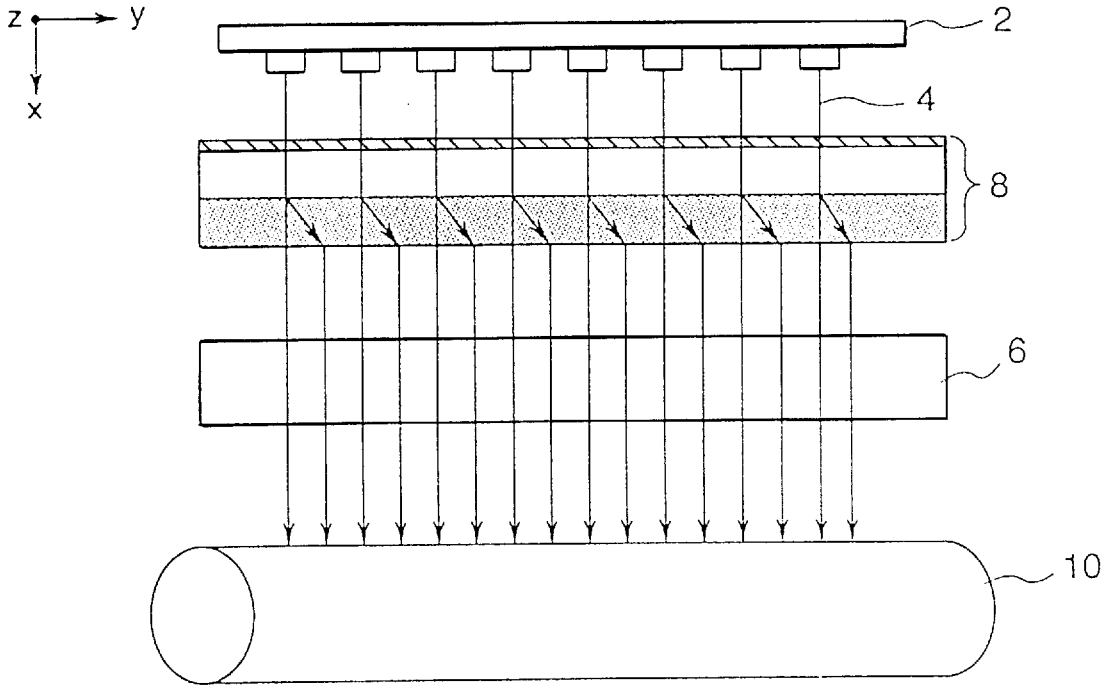
FIG. 13 is a schematic drawing illustrating a third embodiment of the invention.

FIG. 13 illustrates the third embodiment, using the same reference numerals as in FIG. 1. The third embodiment differs from the first embodiment only in that the dot-doubling device 8 is disposed between the linear array 2 and lens array 6, instead of between the lens array 6 and photosensitive drum 10. The structure of the dot-doubling device 8 is the same as in the first embodiment, and the operation of the third embodiment is the same the operation of the first embodiment. Further description will be omitted.

Figure 14:
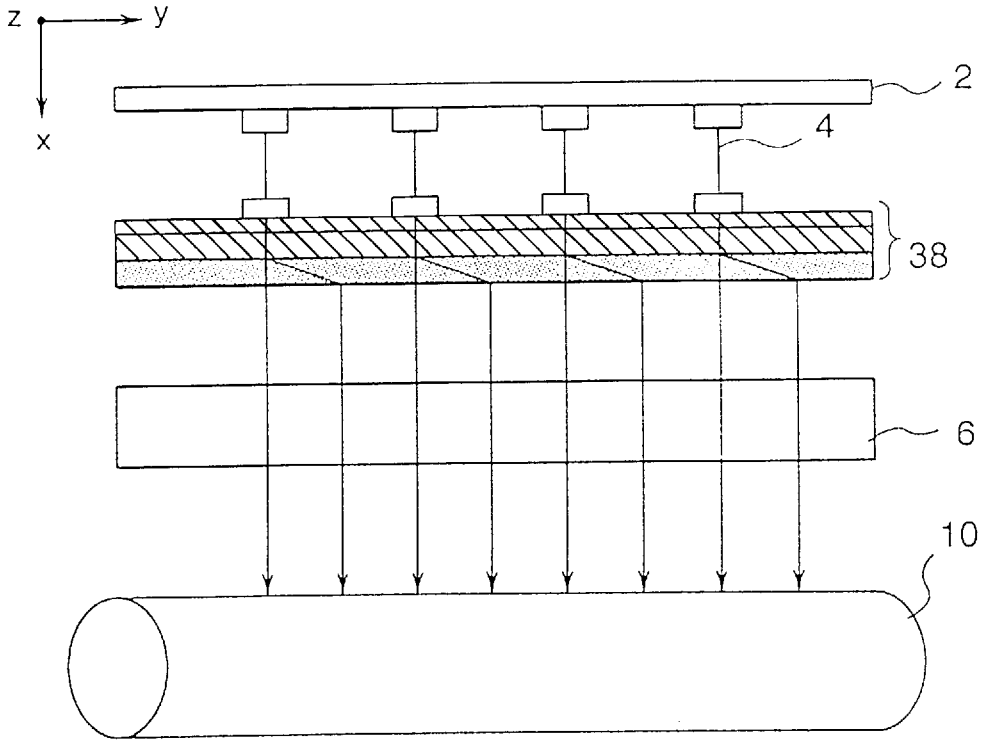
FIG. 14 is a schematic drawing illustrating a fourth embodiment of the invention.

FIG. 14 illustrates the fourth embodiment, using the same reference numerals as in FIG. 10. The fourth embodiment differs from the second embodiment in the same way that the third embodiment differed from the first embodiment: the dot-doubling device 38 is disposed between the linear array 2 and lens array 6, instead of between the lens array 6 and photosensitive drum 10. The structure of the dot-doubling device 38 is the same as in the second embodiment, and the operation of the fourth embodiment is the same as the operation of the second embodiment, so a detailed description will be omitted.

Figure 15:
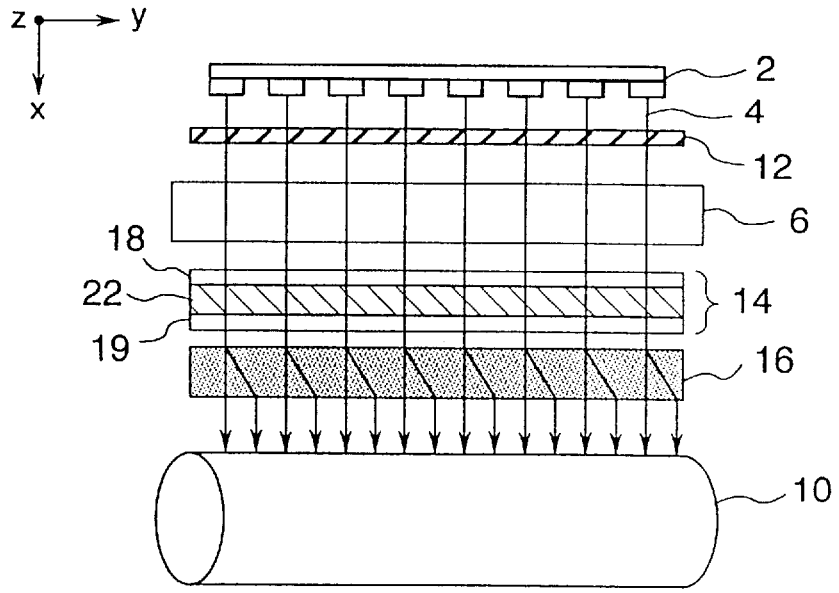
FIG. 15 is a schematic drawing illustrating a fifth embodiment of the invention.

FIG. 15 illustrates the fifth embodiment, using the same reference numerals as in FIGS. 1 and 2. In the fifth embodiment, the lens array 6 is disposed between the polarizer 12 and the ferroelectric liquid crystal cell 14. Otherwise, the fifth embodiment is similar to the first and third embodiments and operates in the same way, so a detailed description will be omitted.

Figure 16:
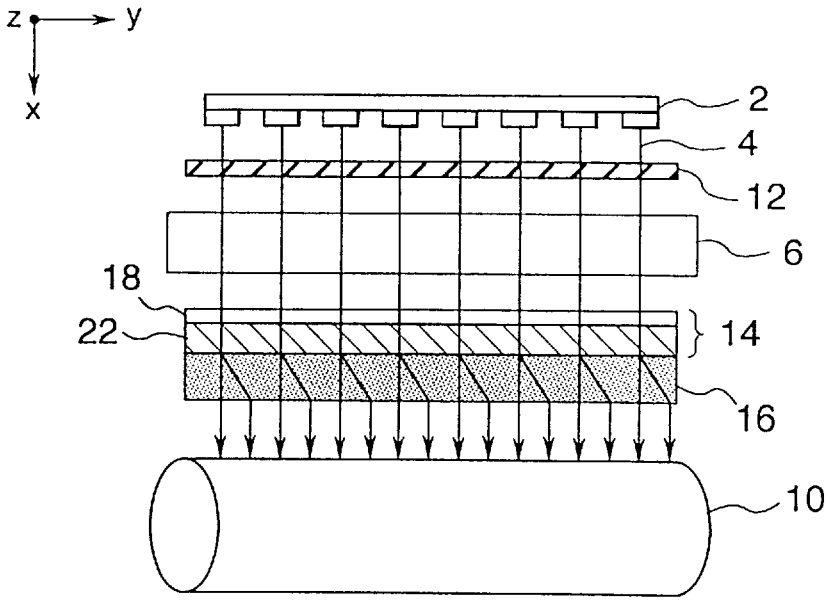
FIG. 16 is a schematic drawing illustrating a sixth embodiment of the invention.

FIG. 16 illustrates the sixth embodiment, using the same reference numerals as in FIGS. 11 and 15. The sixth embodiment combines the features of the second and fifth embodiments, the lens array 6 being disposed between the polarizer 12 and ferroelectric liquid crystal cell 14, and the birefringent plate 16 replacing one confining plate of the ferroelectric liquid crystal cell 14. Operation is as in the second embodiment, so a detailed description will be omitted.

Figure 17:
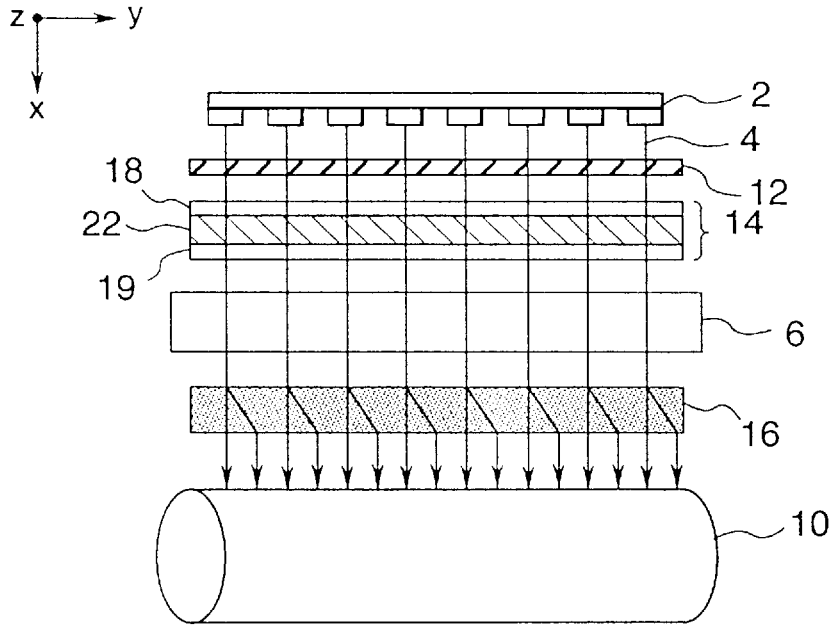
FIG. 17 is a schematics drawing illustrating a seventh embodiment of the invention.

FIG. 17 illustrates the seventh embodiment, using the same reference numerals as in FIGS. 1 and 2. In the seventh embodiment, the lens array 6 is disposed between the ferroelectric liquid crystal cell 14 and birefringent plate 16. Otherwise, the seventh embodiment is similar to the first embodiment and operates in the same way, so a detailed description will be omitted.

Figure 18:
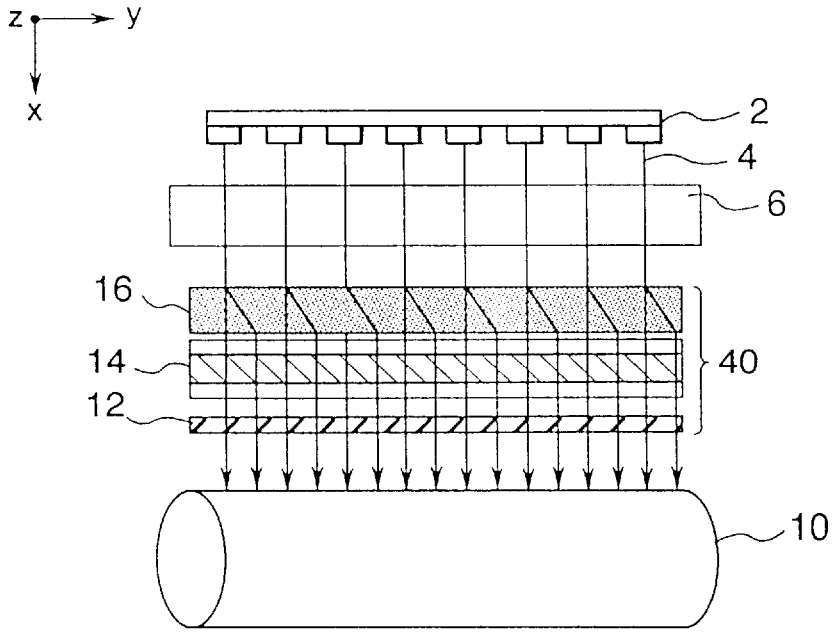
FIG. 18 is a schematic drawing illustrating an eighth embodiment of the invention.

FIG. 18 illustrates the general structure of the eighth embodiment, using the same reference numerals as in FIGS. 1 and 2 to denote identical or equivalent parts. The dot-doubling device 40 of the eighth embodiment comprises the same polarizer 12, ferroelectric liquid crystal cell 14, and birefringent plate 16 as the dot-doubling device 8 of the first embodiment, but these elements are now placed in the reverse order.

Figure 19:
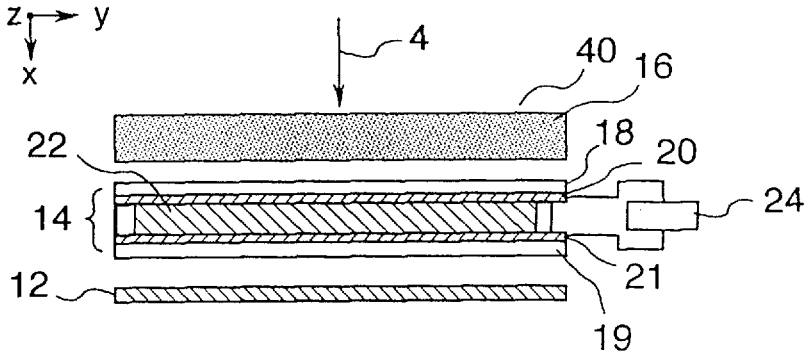
FIG. 19 is a more detailed drawing of the dot-doubling device in the eighth embodiment.

FIG. 19 shows the structure of the dot-doubling device 40 in more detail, using the same reference numerals as in FIG. 2 to denote equivalent parts. The dot-doubling device 40 is identical to the dot-doubling device 8 except that the positions of the polarizer 12 and birefringent plate 16 have been interchanged, and (although this is not visible in the drawing) when a −E electric field is applied to the ferroelectric liquid crystal cell 14, the director of the ferroelectric liquid crystal 22 is aligned in the x-y plane instead of the x-z plane.

The operation of the eighth embodiment will be described with reference to FIGS. 20A and 20B. These drawings employ the same reference numerals and other notation as FIGS. 8A and 8B.

Figure 20B:
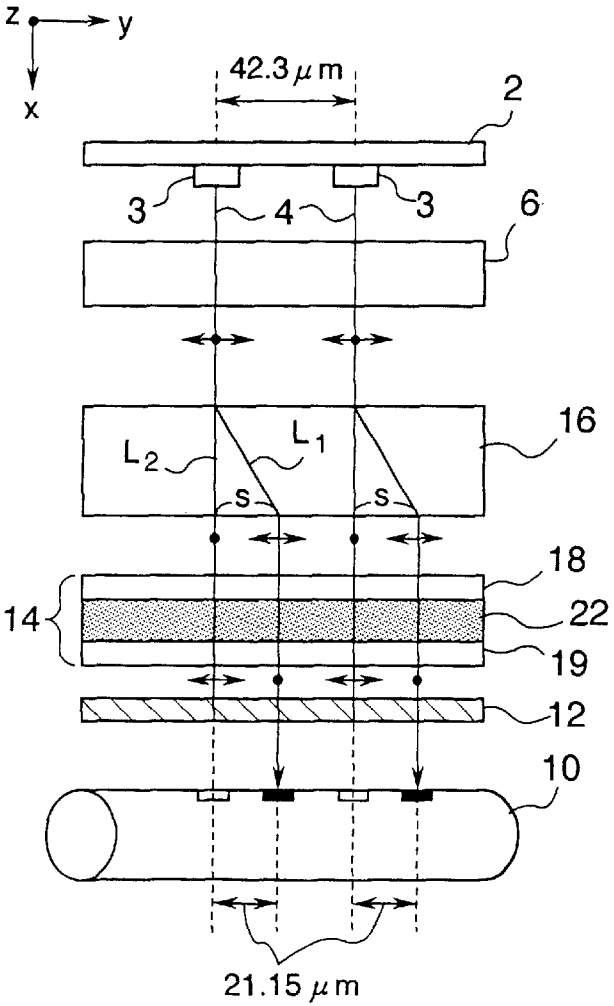
FIG. 20B illustrates the operation of the eighth embodiment in a second state.
Figure 20A:
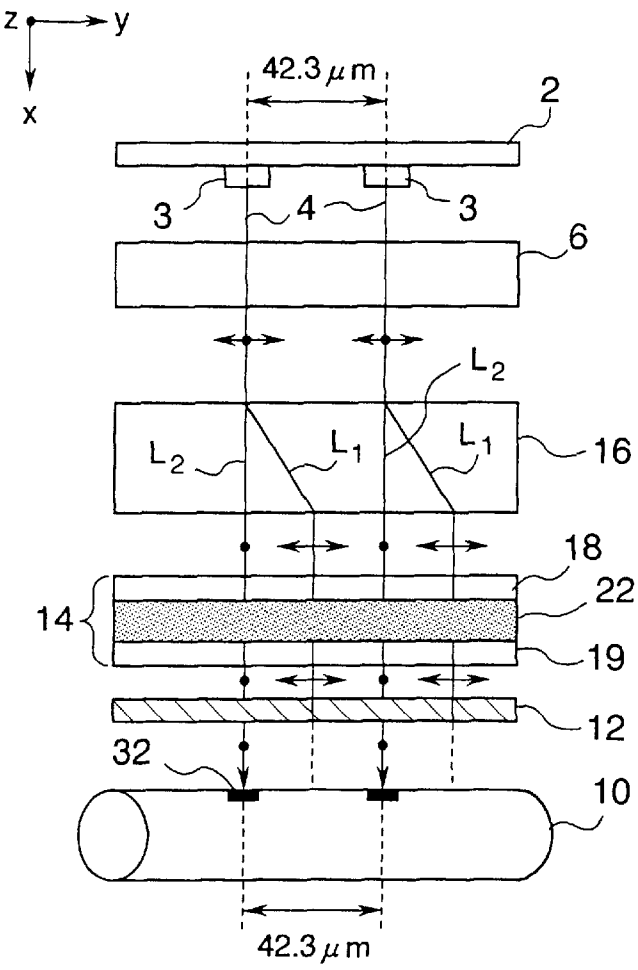
FIG. 20A illustrates the operation of the eighth embodiment in a first state.

Referring to FIG. 20A, first a −E electric field is applied to the ferroelectric liquid crystal cell 14, aligning the director of the ferroelectric liquid crystal 22 in the x-y plane. The linear array 2 is then driven with odd dot data.

The light emitted by the light-emitting elements 3 is focused by the lens array 6 and enters the birefringent plate 16 as natural light. Although natural light has no particular plane of polarization, it can be considered to consist of equal components $L_1$ and $L_2$ polarized in the x-y and x-z planes, respectively. The birefringent plate 16 deflects the component polarized in the x-y plane, which is the principal plane of the birefringent plate 16, and does not deflect the component polarized in the x-z plane, which is perpendicular to the principal plane. The light 4 from each light-emitting element is thus split into two separate beams consisting of the $L_1$ and $L_2$ components, respectively.

The ferroelectric liquid crystal cell 14 does not rotate the planes of polarization of these two beams, so the $L_2$ beam, polarized in the x-z plane, is transmitted through the polarizer 12 while the $L_1$ beam, polarized in the x-y plane, is blocked. Accordingly, only the dots 32 directly facing the light-emitting elements 3 are illuminated.

Referring to FIG. 20B, next a +E electric field is applied to the ferroelectric liquid crystal cell 14, aligning the director of the ferroelectric liquid crystal 22 at a 45° angle to the x-y and x-z planes, and the linear array 2 is driven with the even dot data. The light emitted from each light-emitting element 3 is split into two beams $L_1$ and $L_2$ by the birefringent plate 16 as in FIG. 20A, but now the planes of polarization of these two beams are rotated through a right angle by the ferroelectric liquid crystal cell 14, so that beam $L_1$ becomes polarized in the x-z plane and beam $L_2$ in the x-y plane. Beam $L_1$ is therefore transmitted through the polarizer 12 while beam $L_2$ is blocked, and the dots 34 now illuminated on the photosensitive drum 10 are shifted by a distance S from the dots illuminated in FIG. 20A.

The end effect is thus the same as in the first embodiment: each light-emitting element can illuminate either of two dots on the photosensitive drum 10, and the dot resolution on the photosensitive drum 10 is 21.15 $\mu$m, even though the spacing of the light-emitting elements 3 in the linear array 2 is 42.3 $\mu$m. As in the first embodiment, the birefringent plate 16, ferroelectric liquid crystal cell 14, and polarizer 12 are all disposed parallel to the y-z plane and are not tilted with respect to the linear array 2 and photosensitive drum 10, simplifying the accommodation of the dot-doubling device 40 and lens array 6 between the linear array 2 and photosensitive drum 10.

As in the first seven embodiments, the polarizer 12 and ferroelectric liquid crystal cell 14 combine to form a polarization switching device that transmits light polarized in one of two selectable, perpendicular planes. In FIG. 20A light polarized in the x-z plane is transmitted through the ferroelectric liquid crystal cell 14 and polarizer 12, while light polarized in the x-y plane is blocked. In FIG. 20B, light polarized in the x-y plane is transmitted and light polarized in the x-z plane is blocked.

Figure 21:
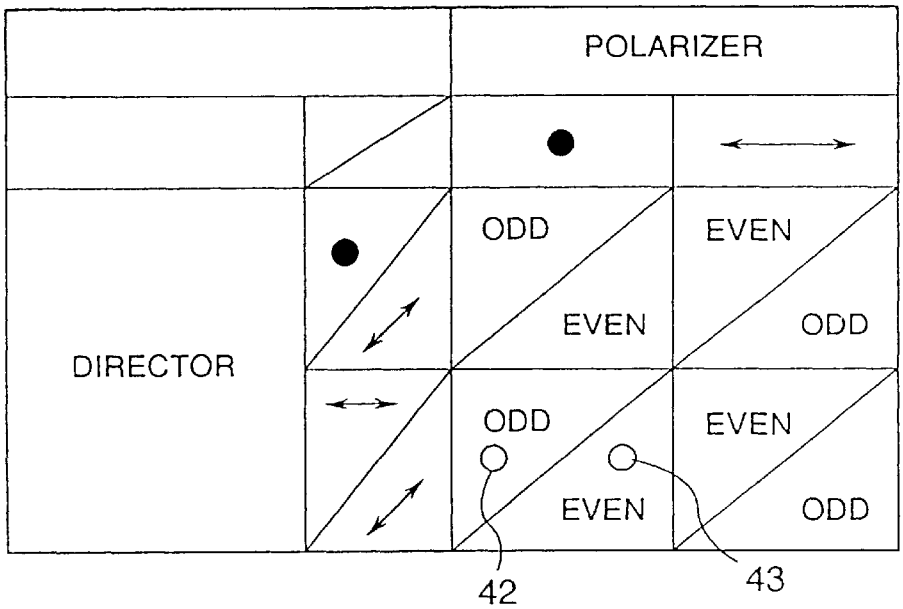
FIG. 21 is a table illustrating various possible combinations of the transmission axis of the polarizer in the eighth embodiment and the director orientations of the ferroelectric liquid crystal cell.

FIG. 21 illustrates various possible combinations of the orientations of the transmission axis of the polarizer 12 and the director of the Liquid crystal 22, using the same notation as in FIG. 9. The combination of orientations of the polarizer 12 and the director of the ferroelectric liquid crystal 22 indicated by circles 42 and 43 in FIG. 21 is employed in the eighth embodiment, circle 42 indicating the state for printing the odd dot data and circle 43 the state for printing the even dot data. The same combination will also be employed in the ninth to fourteenth embodiments, described below. The eighth to fourteenth embodiments can be varied, however, by employing any of the other three combinations in FIG. 21. If the transmission axis of the polarizer 12 is aligned in the y-direction, the odd dot data are printed by switching the ferroelectric liquid crystal cell 14 so that the director is aligned at a 45° angle to the y- and z-directions.

Figure 22:
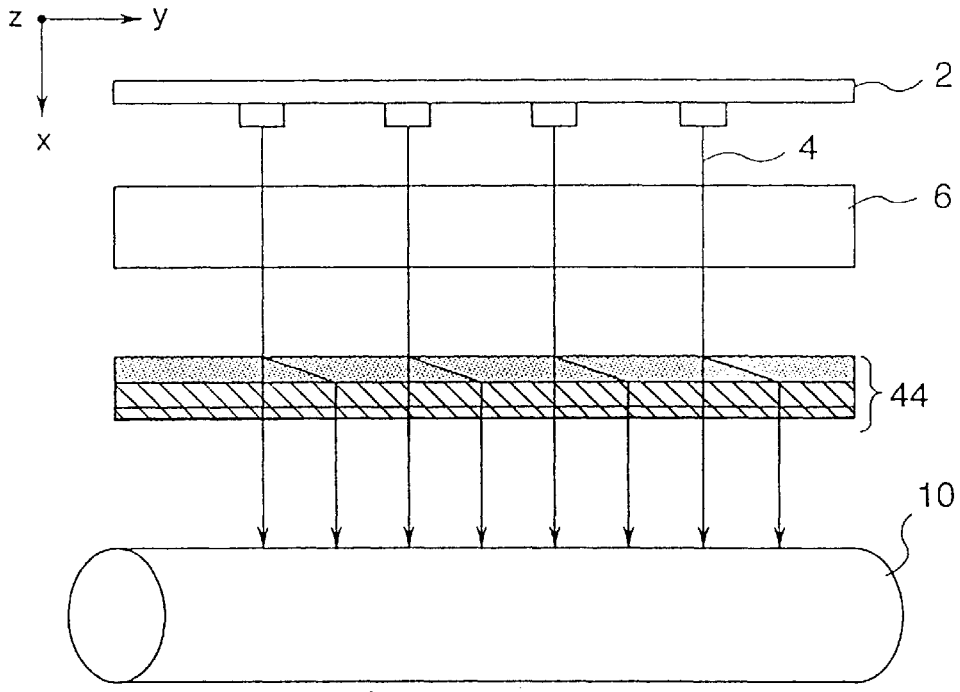
FIG. 22 is a schematic drawing illustrating a ninth embodiment of the invention.

FIG. 22 shows the general structure of the ninth embodiment. The linear array 2, lens array 6, and photosensitive drum 10 are as in the eighth embodiment. The dot-doubling device 44 differs from the dot-doubling device 40 of the eighth embodiment in the same way that the dot-doubling device 38 of the second embodiment differed from the dot-doubling device 8 of the first embodiment.

Figure 23:
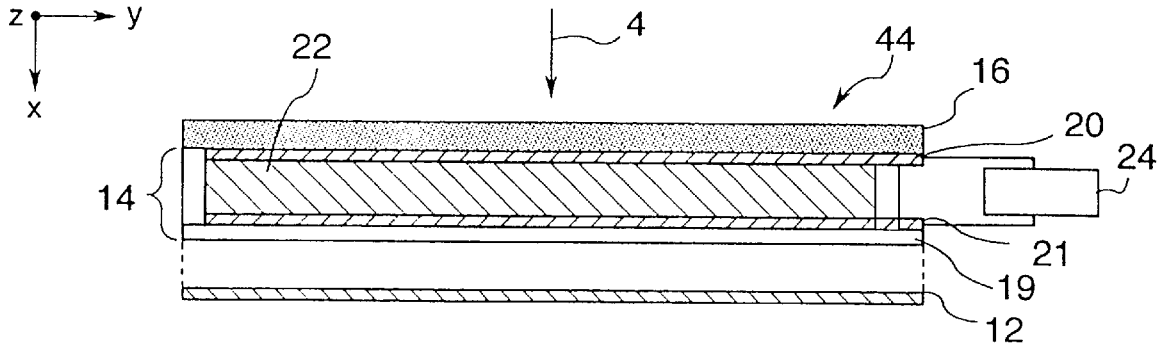
FIG. 23 is a more detailed drawing of the dot-doubling device in the ninth embodiment.

FIG. 23 shows the detailed structure of the dot-doubling device 44 of the ninth embodiment, using the same reference numerals as in FIG. 19 to denote equivalent parts. The glass plate 18 of FIG. 19 has been removed, and the transparent electrode 20 is formed directly on the birefringent plate 16, which now serves as one of the walls of the ferroelectric liquid crystal cell 14.

The ninth embodiment operates like the eighth embodiment, so a detailed description will be omitted. The advantages are the same as in the second embodiment: doubled dot resolution, a compact structure which need not exceed two millimeters in thickness, and reduced loss of light due to internal reflection.

Figure 24:
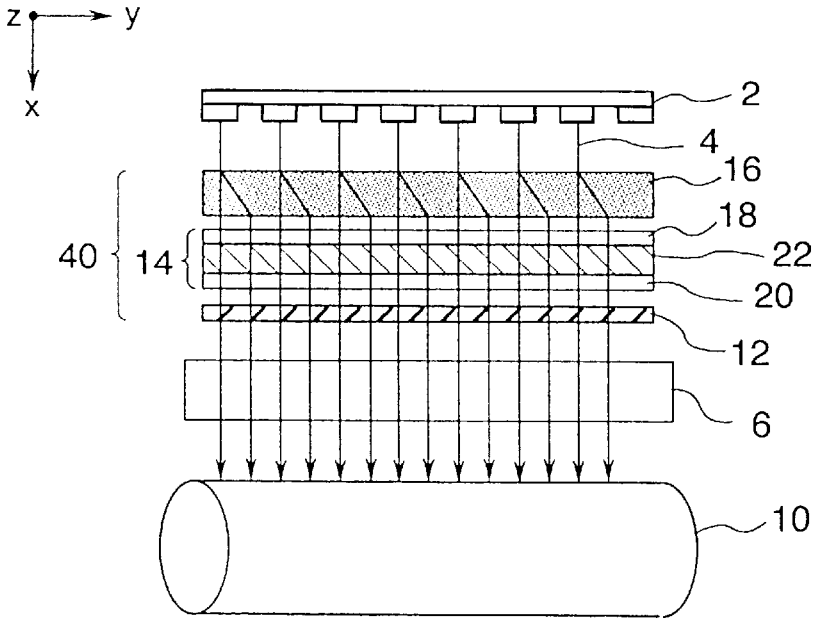
FIG. 24 is a schematic drawing illustrating a tenth embodiment of the invention.

FIG. 24 shows the tenth embodiment, which differs from the eighth embodiment only in that the lens array 6 is placed between the polarizer 12 and photosensitive drum 10 instead of between the linear array 2 and birefringent plate 16. The tenth embodiment operates like the eighth embodiment and provides the same advantages, so a detailed description will be omitted.

Figure 25:
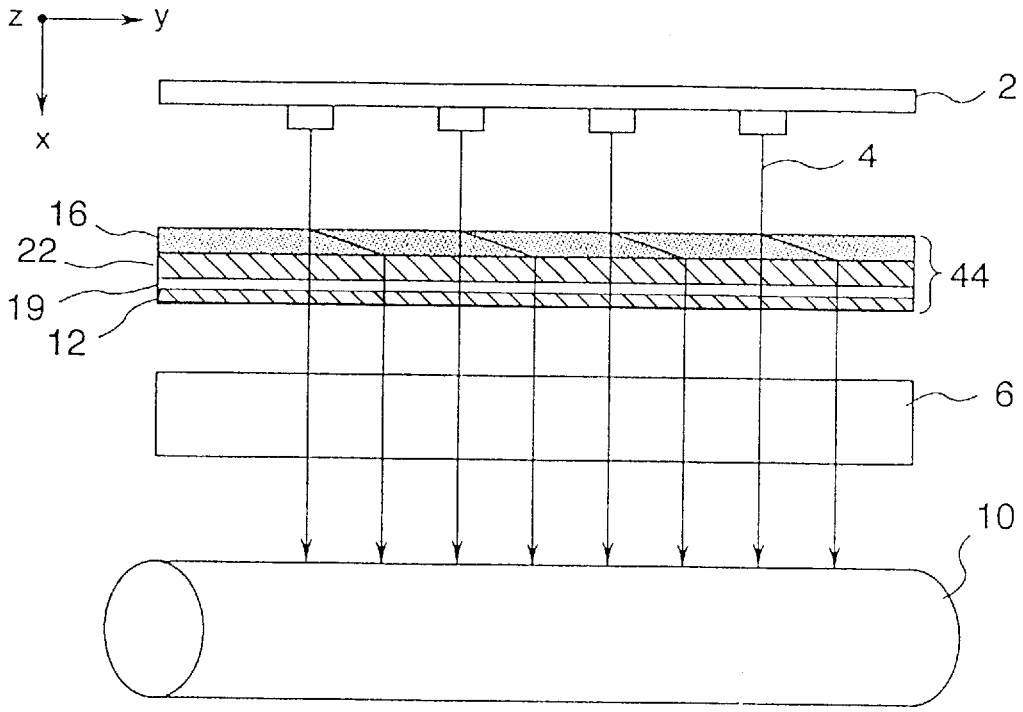
FIG. 25 is a schematic drawing illustrating an eleventh embodiment of the invention.

FIG. 25 shows the eleventh embodiment, which combines the features of the ninth and tenth embodiments, placing the lens array 6 between the dot-doubling device 44 and photosensitive drum 10. The dot-doubling device 44 is the same as in the ninth embodiment, the birefringent plate 16 forming one wall of the ferroelectric liquid crystal cell. The eleventh embodiment operates like the ninth embodiment and provides the same advantages, so a detailed description will be omitted.

Figure 26:
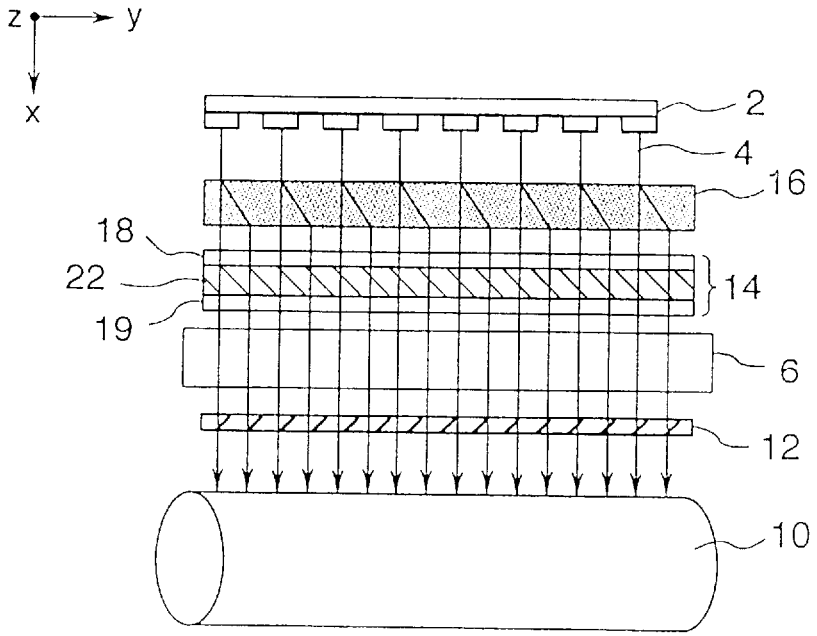
FIG. 26 is a schematic drawing illustrating a twelfth embodiment of the invention.

FIG. 26 shows the twelfth embodiment, using the same reference numerals as in FIGS. 18 and 19. The twelfth embodiment resembles the eighth embodiment except that the lens array 6 is disposed between the ferroelectric liquid crystal cell 14 and polarizer 12. The twelfth embodiment operates like the eighth embodiment and provides the same advantages, so a detailed description will be omitted.

Figure 27:
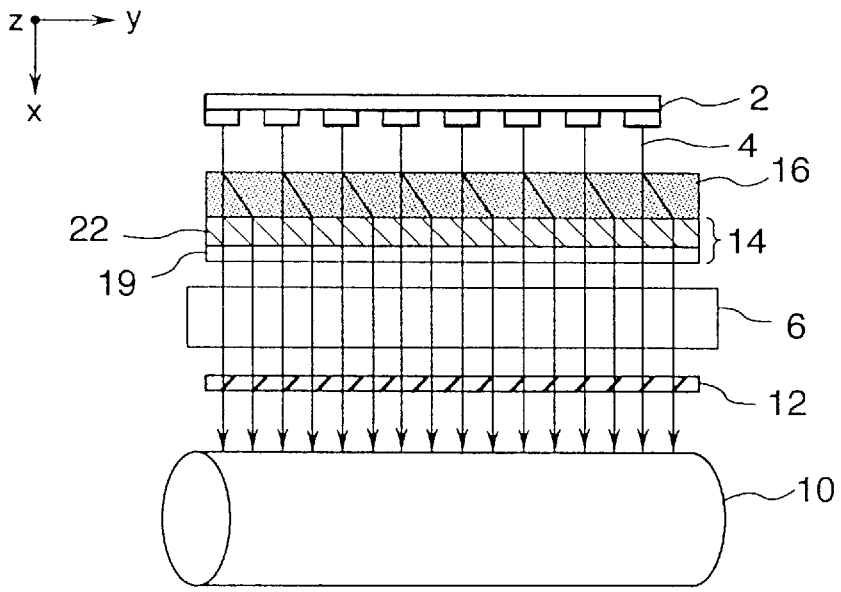
FIG. 27 is a schematic drawing illustrating a thirteenth embodiment of the invention.

FIG. 27 shows the thirteenth embodiment, using the same reference numerals as in FIGS. 22 and 23. The thirteenth embodiment resembles the ninth embodiment except that the lens array 6 is disposed between the ferroelectric liquid crystal cell 14 and polarizer 12. The thirteenth embodiment operates like the ninth embodiment and provides the same advantages, so a detailed description will be omitted.

Figure 28:
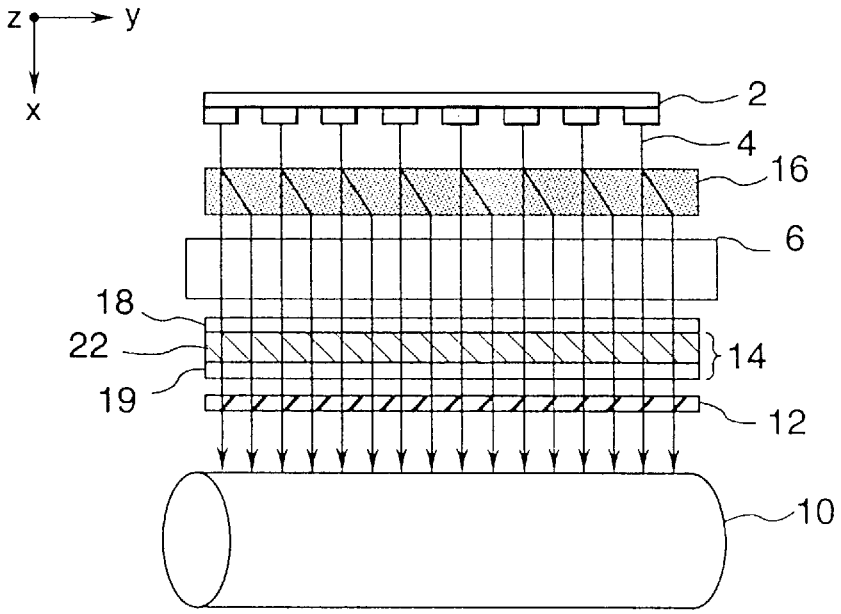
FIG. 28 is a schematic drawing illustrating a fourteenth embodiment of the invention.

FIG. 28 shows the fourteenth embodiment, using the same reference numerals as in FIGS. 18 and 19. The fourteenth embodiment resembles the eighth embodiment but places the lens array 6 between the birefringent plate 16 and ferroelectric liquid crystal cell 14. The fourteenth embodiment operates like the eighth embodiment and provides the same advantages, so a detailed description will be omitted.

As is clear from preceding embodiments, the first, aspect of the invention provides not only a compact dot-doubling structure but also considerable choice regarding the placement of the lens array 6. It furthermore permits two choices regarding the order of the polarizer 12, ferroelectric liquid crystal cell 14, and birefringent plate 16. The first aspect of the invention accordingly affords a great deal of design freedom and can be practiced easily, with relatively few design restrictions.

Next the second aspect of the invention will be described.

Figure 29:
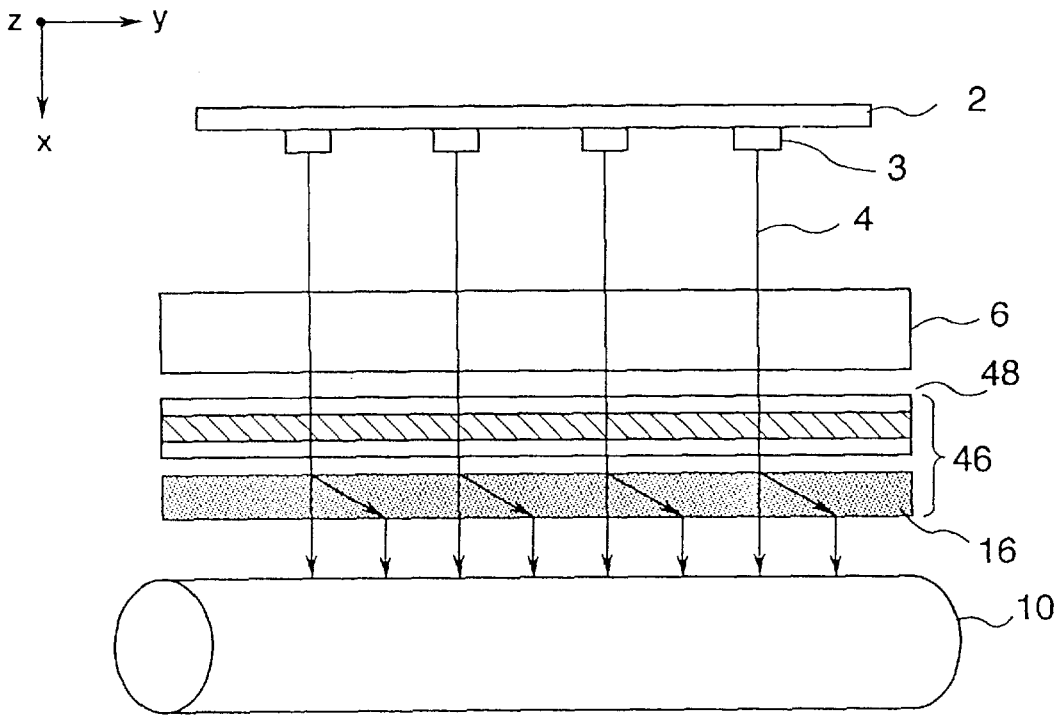
FIG. 29 is a schematic drawing illustrating a fifteenth embodiment, illustrating the second aspect of the invention.

FIG. 29 shows the general structure of a fifteenth embodiment, illustrating the second aspect of the invention. The linear array 2, lens array 6, and photosensitive drum 10 are the same as in FIG. 1. Disposed between the lens array 6 and photosensitive drum 10 is a dot-doubling device 46 comprising a ferroelectric liquid crystal cell 48 and a birefringent plate 16. The birefringent plate 16 is the same as in the preceding embodiments, and is again oriented so that its principal plane is parallel to the longitudinal axis of the linear array 2 (parallel to the x-y plane and perpendicular to the z-direction). Light 4 emitted from the light-emitting elements 3 in the linear array 2 is focused by the lens array 6, is polarized in either the x-y or x-z plane by the ferroelectric liquid crystal cell 48, is deflected or not deflected by the birefringent plate 16, and illuminates dots on the photosensitive drum 10.

Figure 30:
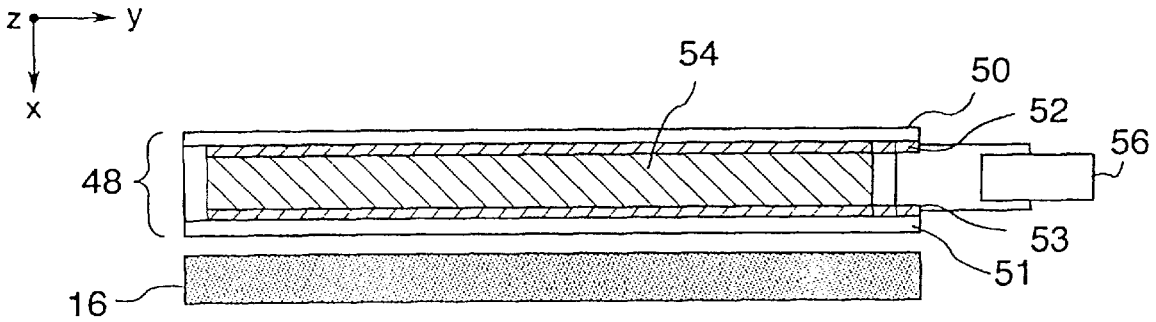
FIG. 30 is a more detailed drawing of the dot-doubling device in the fifteenth embodiment.

FIG. 30 shows the structure of the dot-doubling device 46 in more detail. The ferroelectric liquid crystal cell 48 comprises two parallel glass plates 50 and 51 having transparent electrodes 52 and 53 on their facing surfaces. These surfaces are adapted to anchor a chiral smectic C-phase ferroelectric liquid crystal, which is one component of an absorptive layer 54 confined between the glass plates 50 and 51. The other component of the absorptive layer 54 is a dichroic dye. A driving circuit 56 drives the transparent electrode 52 and 53 to create an electric field across the absorptive layer 54.

Figure 31:
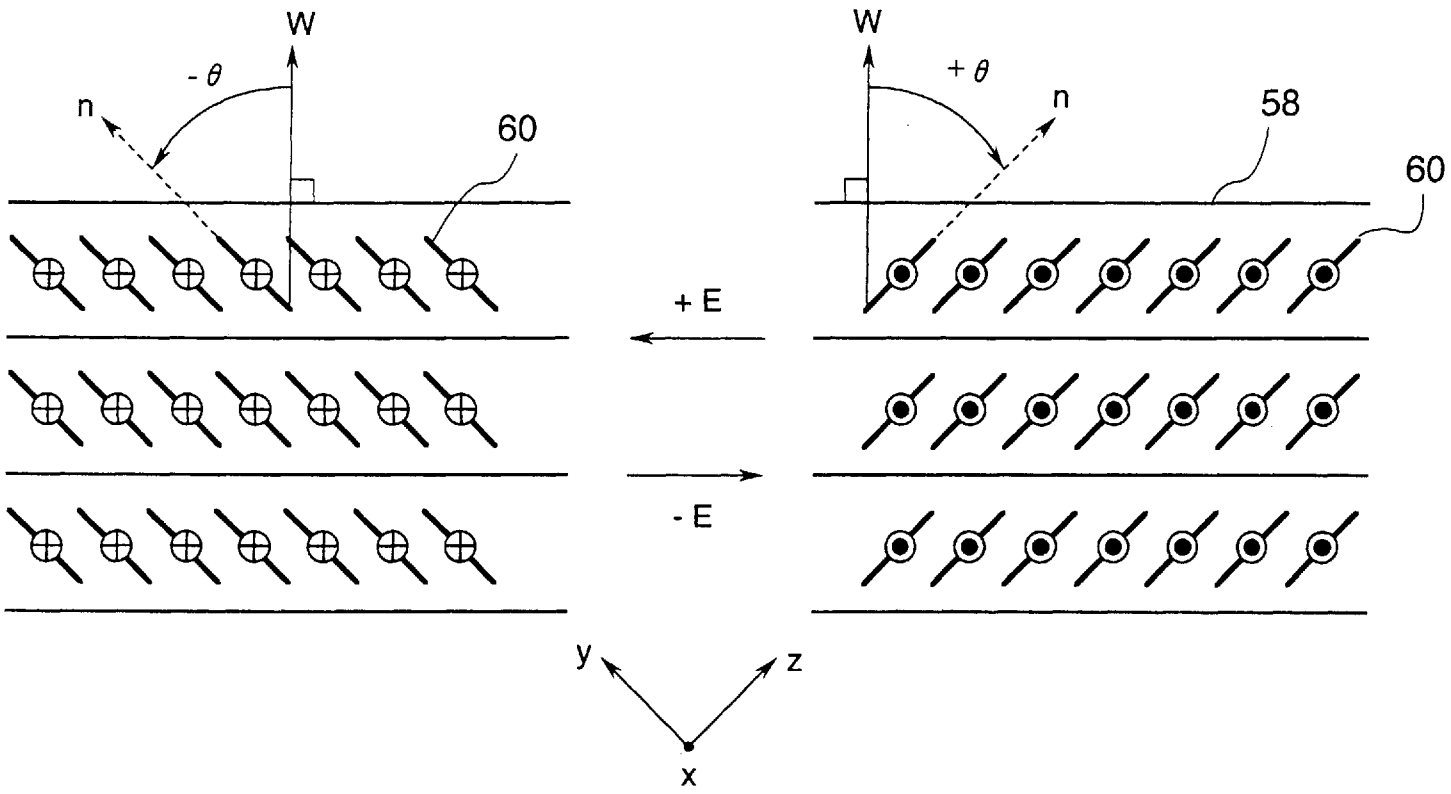
FIG. 31 illustrates the response of the ferroelectric liquid crystal cell in FIG. 29 to an applied electric field.

FIG. 31 illustrates the response of the ferroelectric liquid crystal in the absorptive layer 54 to the electric field. The letter W again denotes the direction normal to the smectic layers of the ferroelectric liquid crystal, and the letter n denotes the director of the ferroelectric liquid crystal. When a −E electric field is applied, the long axes of the liquid crystal molecules 60 align in a direction tilted by an angle −θ to the normal direction W, as shown on the left in FIG. 31. That is, there is an angle −θ between the director n and normal direction W. When a +E electric field is applied, the alignment shifts so that there is an angle of +θ between the director n and normal direction W.

Differing from the preceding embodiments, the angle θ in the fifteenth embodiment is 45°, so the director n shifts by a total angle of 2θ or 90°, a right angle. When a −E electric field is applied, the director n points in the y-direction. When a +E electric field is applied, the director n points in the z-direction.

Figure 32:
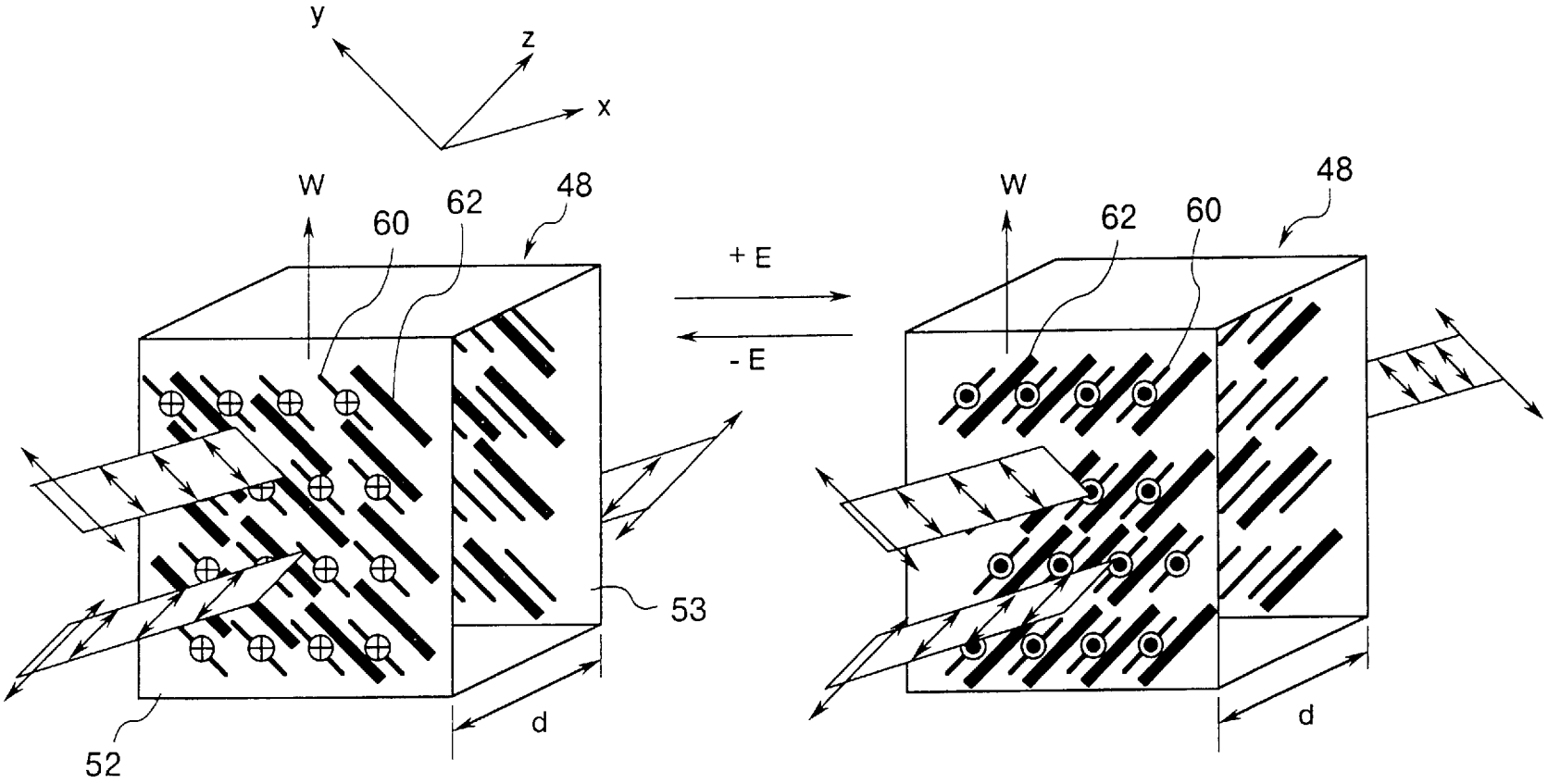
FIG. 32 illustrates selective polarization of natural light by the ferroelectric liquid crystal cell in FIG. 29.

FIG. 32 illustrates the transmission of polarized light by the ferroelectric liquid crystal cell 48. The long axes of the dichroic dye molecules 62 align with the long axes of the ferroelectric liquid crystal molecules 60, so they also shift their alignment in response to the applied electric field. It will be assumed here that the long axes of the dichroic dye molecules 62 are the absorption axes.

When the transparent electrodes 52 and 53 are driven so that a −E electric field is applied, aligning the long axes of the liquid crystal and dichroic dye molecules 60 and 62 in the y-direction as shown at the left in FIG. 32, light polarized in the x-y plane, parallel to the absorption axes of the dichroic dye molecules 62, is absorbed by the dichroic dye molecules 62 and does not pass through the ferroelectric liquid crystal cell 48. The thickness d of the ferroelectric liquid crystal cell 48 can be selected to obtain substantially complete absorption. Light polarized in the x-z plane, perpendicular to the absorption axes of the dichroic dye molecules 62, passes through the ferroelectric liquid crystal cell 48 without being absorbed.

When a +E electric field is applied, aligning the liquid crystal and dichroic dye molecules 60 and 62 in the z-direction as shown at the right in FIG. 32, the opposite situation obtains. Light polarized in the x-y plane passes through the ferroelectric liquid crystal cell 48, while light polarized in the x-z plane is absorbed.

Figure 33B:
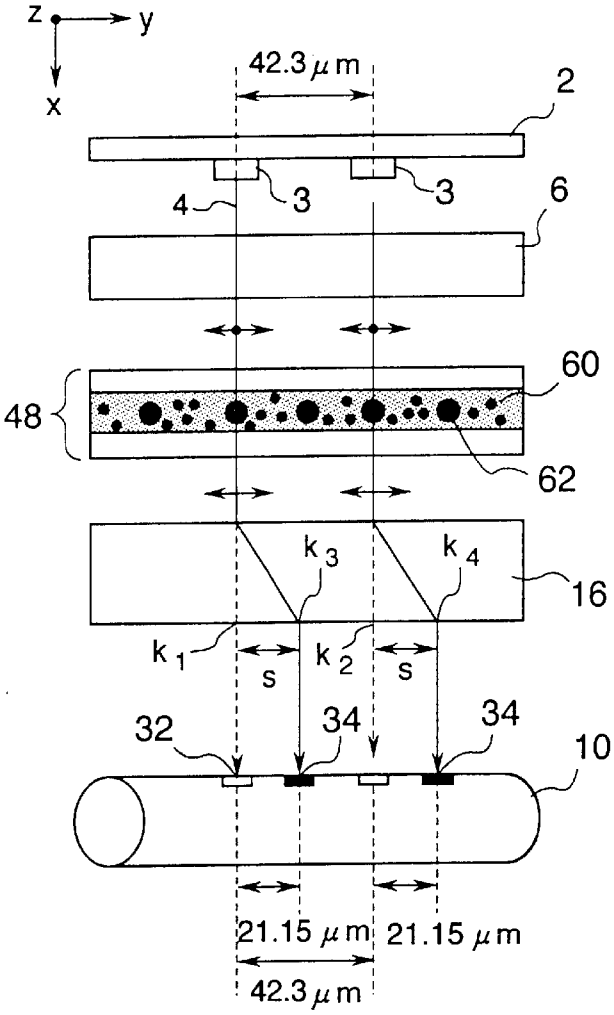
FIG. 33B illustrates the operation of the fifteenth embodiment in a second state.
Figure 33A:
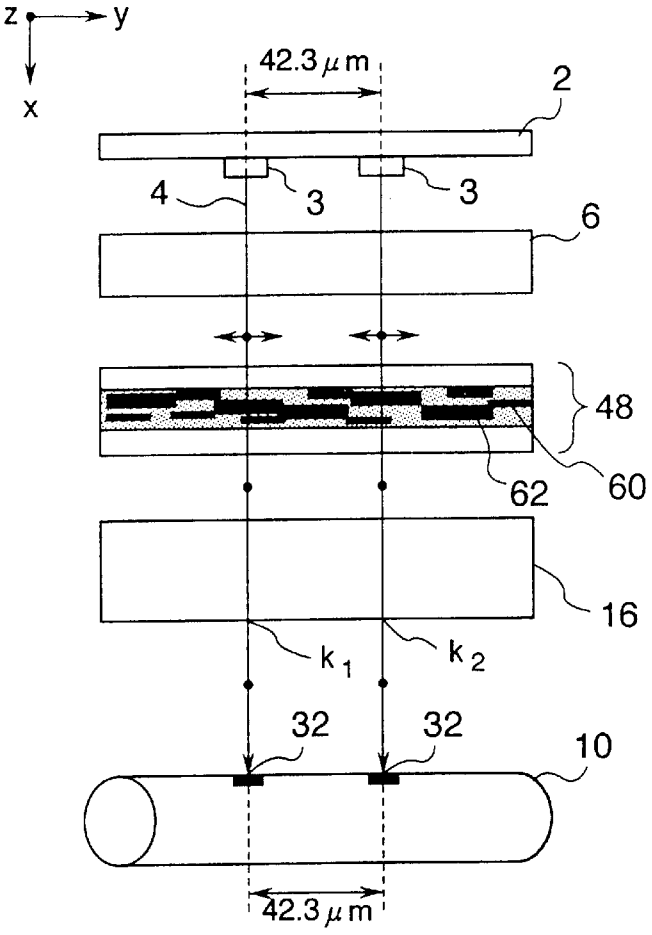
FIG. 33A illustrates the operation of the fifteenth embodiment in a first state.

The operation of the fifteenth embodiment will be described with reference to FIGS. 33A and 33B. FIG. 33A shows the state in which a −E electric field is applied and the linear array 2 is driven according to the odd dot data. FIG. 33B shows the state in which a +E electric field is applied and the linear array 2 is driven according to the even dot data. The same notation is used as in FIGS. 8A and 8B to denote planes of polarization.

In FIG. 33A, light 4 emitted from the light-emitting elements 3 is focused by the lens array 6 and enters the ferroelectric liquid crystal cell 48 as natural light. As pointed out earlier, natural light can be considered to consist of equal components polarized in the x-y and x-z planes. Since the absorption axes of the dichroic dye molecules 62 in the ferroelectric liquid crystal cell 48 are aligned in the y-direction, the x-y component of the light 4 is absorbed, and the light that exits the ferroelectric liquid crystal cell 48 is polarized in the x-z plane. This light emerges from the birefringent plate 16 at points $k_1$ and $k_2$ without being deflected. Dots 32 on the photosensitive drum 10, aligned with the light-emitting elements 3 in the linear array 2, are accordingly illuminated.

In FIG. 33B, the absorption axes of the dichroic dye molecules 62 are aligned in the z-direction, so the x-z component of the light 4 is absorbed and the light that emerges from the ferroelectric liquid crystal cell 48 is polarized in the x-y plane. This light is deflected in the y-direction in the birefringent plate 16 by the amount S as described in the first aspect of the invention, emerging at points such as $k_3$ and $k_4$. The dots 34 illuminated on the photosensitive drum 10 are thus disposed midway between the dots 32 that were illuminated in FIG. 33A.

From the preceding description it will be apparent that the fifteenth embodiment provides the same effect as the first embodiment, doubling the dot resolution so that a linear array 2 with a spacing of 42.3 μm between light-emitting elements 3, for example, can be used to print with a dot resolution of 21.15 μm. A further advantage is that, since no separate polarizer 12 is required, the dot-doubling device 46 in the fifteenth embodiment has a simpler structure than the dot-doubling device 8 in the first embodiment, and can be thinner.

Figure 34:
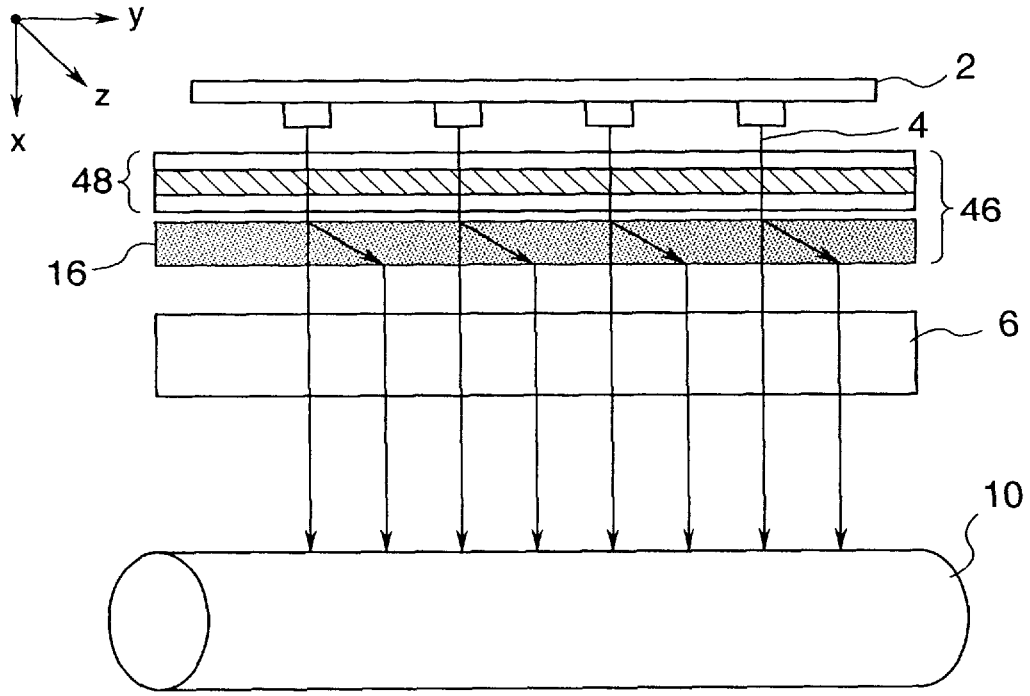
FIG. 34 is a schematic drawing illustrating a sixteenth embodiment of the invention.

FIG. 34 shows the general structure of the sixteenth embodiment, using the same reference numerals as in FIG. 29. In the sixteenth embodiment the lens array 6 is disposed between the dot-doubling device 46 and the photosensitive drum 10; that is, between the birefringent plate 16 and the photosensitive drum 10. In other respects the structure of the sixteenth embodiment is the same as the fifteenth embodiment, and the operation is the same, so further description will be omitted.

Figure 35:
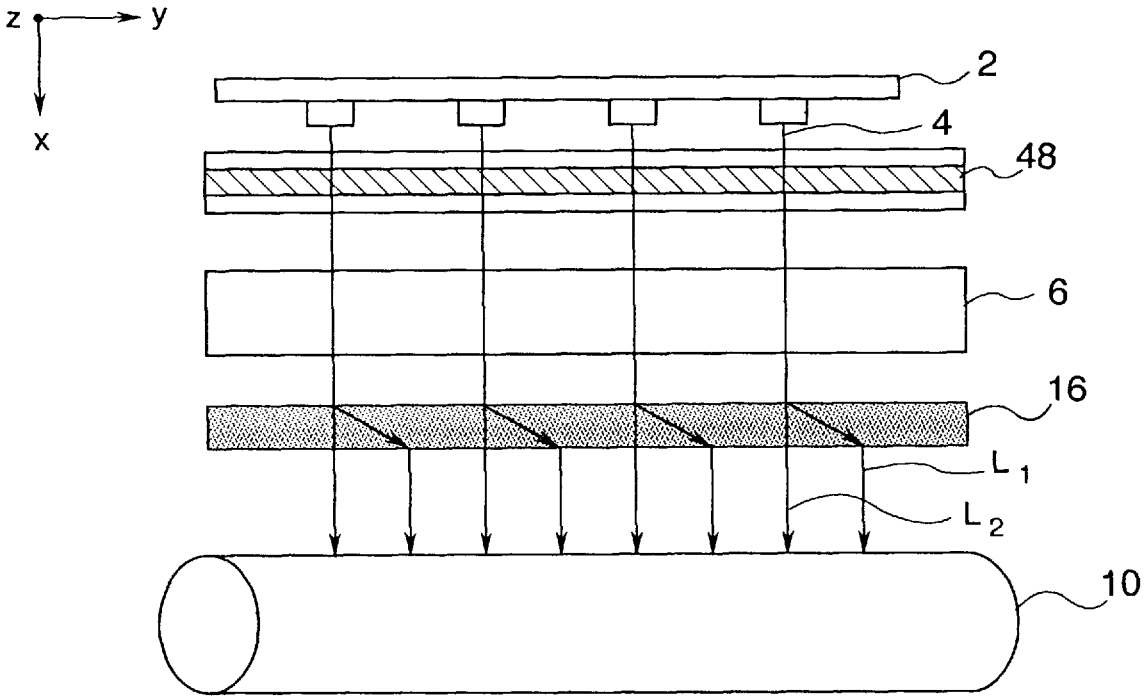
FIG. 35 is a schematic drawing illustrating a seventeenth embodiment of the invention.

FIG. 35 shows the general structure of the seventeenth embodiment, again using the same reference numerals as in FIG. 29. The seventeenth embodiment places the lens array 6 between the ferroelectric liquid crystal cell 48 and the birefringent plate 16, but is otherwise similar to the fifteenth embodiment. The operation is also the same as in the fifteenth embodiment, so a detailed description will be omitted.

Figure 36:
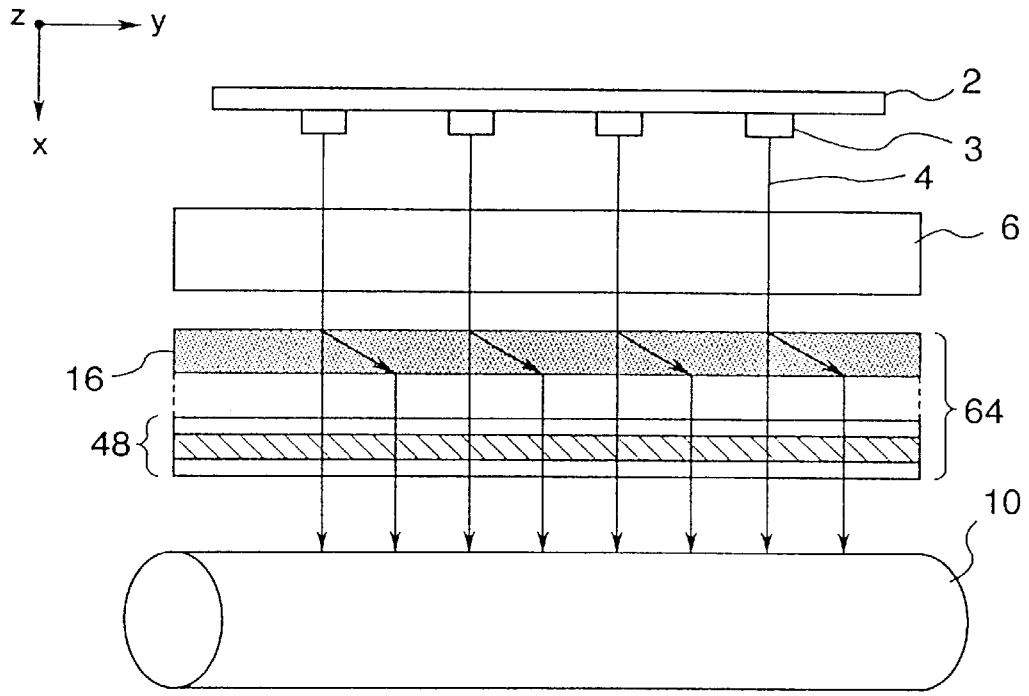
FIG. 36 is a schematic drawing illustrating an eighteenth embodiment of the invention.

FIG. 36 shows the general structure of the eighteenth embodiment. The linear array 2, lens array 6, and photosensitive drum 10 are the same as in the fifteenth embodiment, and the dot-doubling device 64 comprises the same birefringent plate 16 and ferroelectric liquid crystal cell 48 as in the fifteenth embodiment, but these are now disposed so that the birefringent plate 16 is placed between the linear array 2 and the ferroelectric liquid crystal cell 48 (more precisely, between the lens array 6 and the ferroelectric liquid crystal cell 48).

Figure 37:
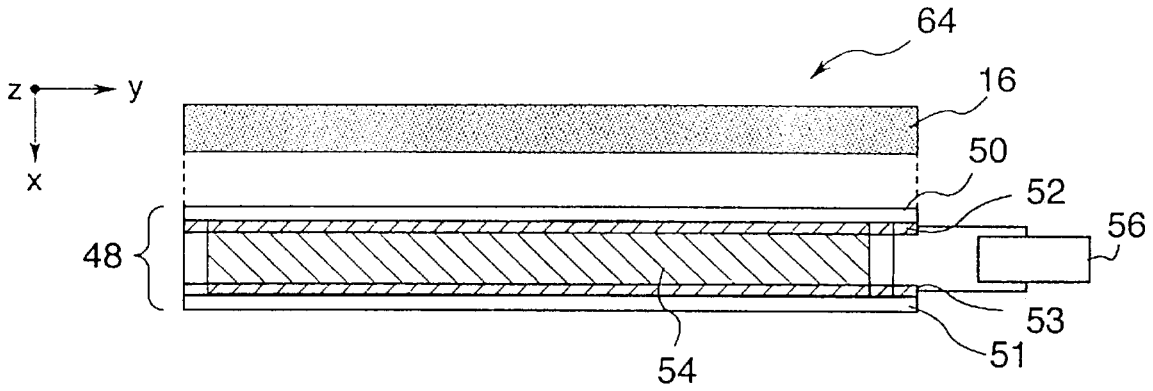
FIG. 37 is a more detailed drawing of the dot-doubling device in the eighteenth embodiment.

FIG. 37 shows the structure of the dot-doubling device 64 in more detail, using the same reference numerals as in FIG. 30. The only difference between FIGS. 30 and 37 is that in FIG. 37, the birefringent plate 16 is disposed above the ferroelectric liquid crystal cell 48 instead of below. The ferroelectric liquid crystal cell 48 is oriented as in the preceding embodiments, with its principal plane parallel to the x-y plane.

Figure 38B:
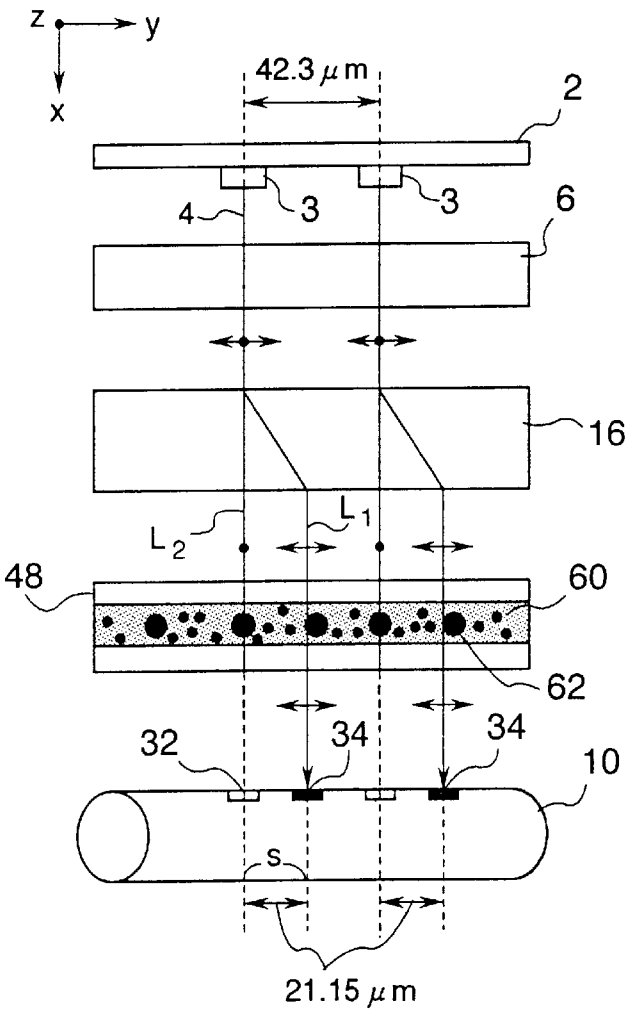
FIG. 38B illustrates the operation of the eighteenth embodiment in a second state.
Figure 38A:
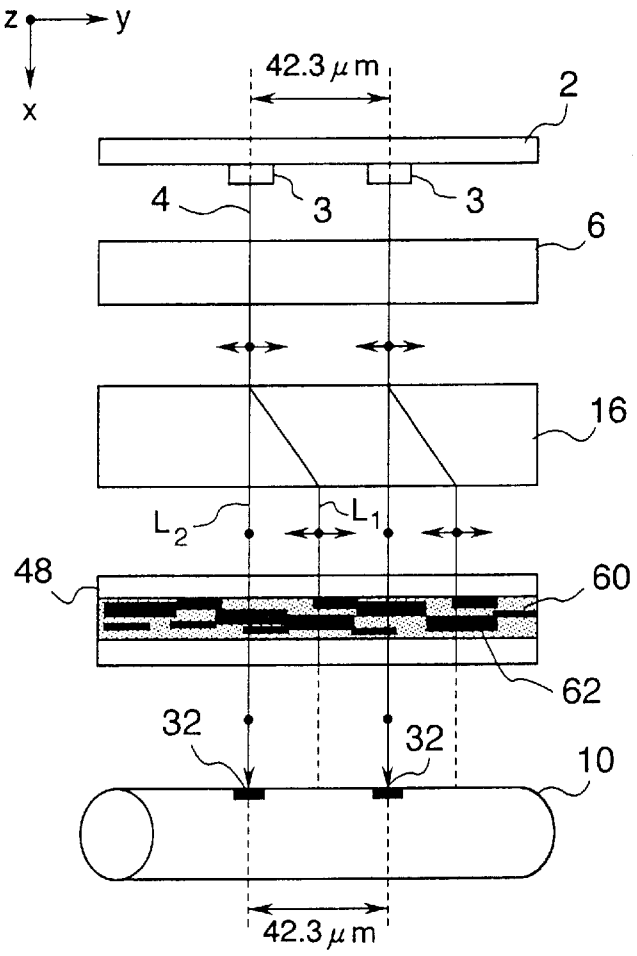
FIG. 38A illustrates the operation of the eighteenth embodiment in a first state.

The operation of the eighteenth embodiment will be described with reference to FIGS. 38A and 38B, using the same notation as in FIGS. 33A and 33B. FIG. 38A shows the state in which a −E electric field is applied and the linear array 2 is driven according to the odd dot data. FIG. 38B shows the state in which a +E electric field is applied and the linear array 2 is driven according to the even dot data.

In FIG. 38A, light 4 emitted from each light-emitting element 3 is focused by the lens array 6, enters the birefringent plate 16, and is split into two beams $L_1$ and $L_2$ as in the eighth embodiment. Both beams enter the ferroelectric liquid crystal cell 48, but the absorption axes of the dichroic dye molecules 62 in the ferroelectric liquid crystal cell 48 are aligned in the y-direction, so beam $L_1$, which is polarized in the x-y plane, is absorbed and only beam $L_2$, which is polarized in the x-z plane, is transmitted through to the photosensitive drum 10. Dots 32 aligned with the light-emitting elements 3 in the linear array 2 are accordingly illuminated.

In FIG. 38B, the absorption axes of the dichroic dye molecules 62 in the ferroelectric liquid crystal cell 48 are aligned in the z-direction, so beam $L_2$, which is polarized in the x-z plane, is absorbed while beam $L_1$, which is polarized in the x-y plane, is transmitted through to the photosensitive drum 10. Dots 34 disposed between the dots 32 are thus illuminated.

The eighteenth embodiment provides the same effect as the fifteenth embodiment, enabling a linear array 2 with a spacing of 42.3 $\mu$m between light-emitting elements 3, for example, to illuminate dots with a resolution of 21.15 $\mu$m.

Figure 39:
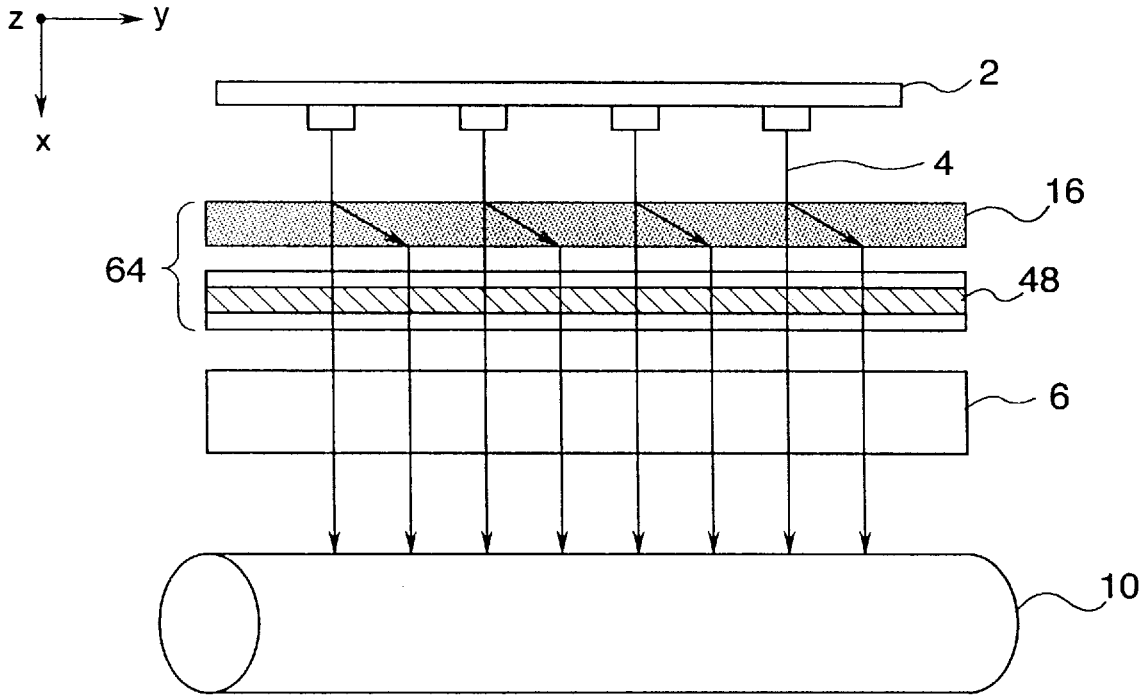
FIG. 39 is a schematic drawing illustrating a nineteenth embodiment of the invention.

FIG. 39 shows the structure of the nineteenth embodiment, using the same reference numerals as in FIG. 36. In the nineteenth embodiment the lens array 6 is disposed between the dot-doubling device 64 and the photosensitive drum 10, i.e. between the ferroelectric liquid crystal cell 48 and the photosensitive drum 10. The structure and operation of the nineteenth embodiment are otherwise the same as in the eighteenth embodiment, so further details will be omitted.

Figure 40:
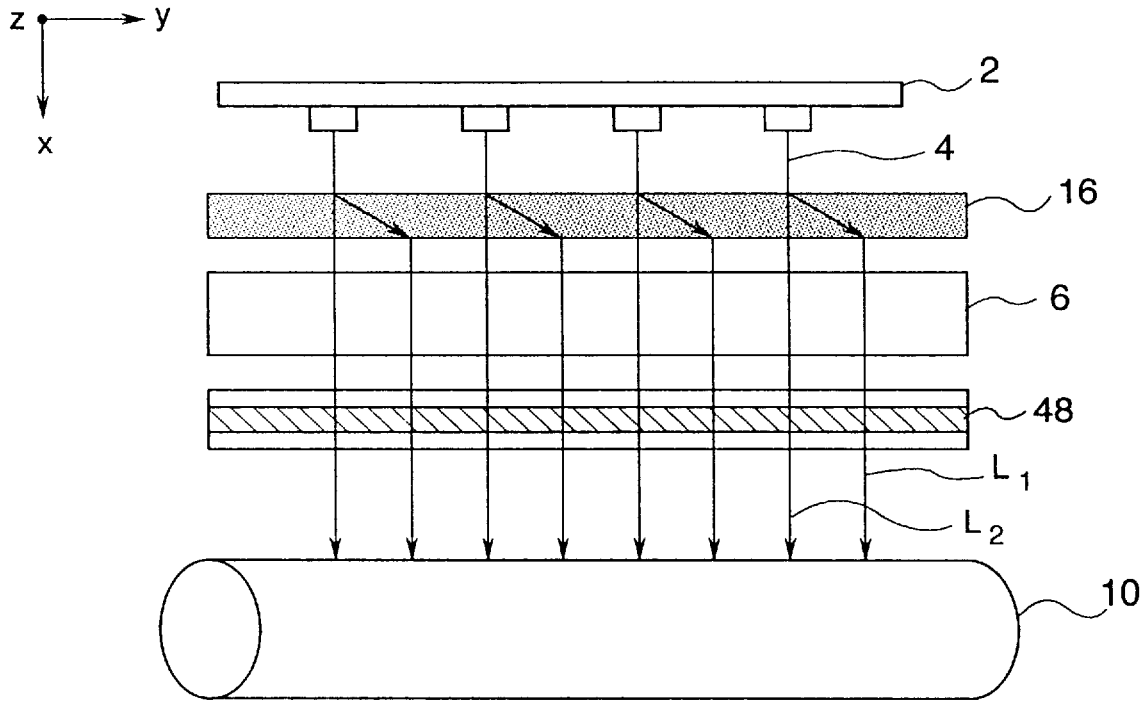
FIG. 40 is a schematic drawing illustrating a twentieth embodiment of the invention.

FIG. 40 shows the structure of the twentieth embodiment, again using the same reference numerals as in FIG. 36. The twentieth embodiment places the lens array 6 between the birefringent plate 16 and the ferroelectric liquid crystal cell 48, but is otherwise similar to the eighteenth embodiment, and operates in the same way. A detailed description will be omitted.

As the preceding embodiments show, the second aspect of the invention also provides considerable freedom in the arrangement of its constituent elements, and places relatively few restrictions on the design of the printer in which it is used.

The invention is not limited to the embodiments described above, but allows still further modifications.

For example, the fifteenth, sixteenth, eighteenth, and nineteenth embodiments can be modified by using the birefringent plate 16 as one wall of the ferroelectric liquid crystal cell 48, replacing the glass plate 53 in FIG. 30 or the glass plate 52 in FIG. 37.

The first aspect of the invention is not restricted to the use of a ferroelectric liquid crystal cell 14 for selectively rotating the plane of polarization of the light. Any type of polarization rotation switch that can interchange two perpendicular planes of polarization in response to an applied signal may be employed. Similarly, in the second aspect of the invention, any type of polarization switch that transmits light polarized in one or another of two perpendicular planes, responsive to an applied signal, can be employed in place of the ferroelectric liquid crystal cell 48.

Applicability of the invention is not limited to LED printers. It can be employed in an electrophotographic printer that employs a linear array of any type of light-emitting emitting elements.

Those skilled in the art will recognize that various other modifications can be made without departing from the scope claimed below.

What is claimed is:

1. An optical system for directing light emitted by an array of light-emitting elements onto a photosensitive medium in an electrophotographic printer so as to enable each light-emitting element to illuminate two dots, comprising:

a birefringent plate disposed between said array of light-emitting elements and said photosensitive medium, for transmitting, without deflection, light that is polarized in a first plane, and transmitting, with deflection, light that is polarized in a second plane perpendicular to said first plane; and a polarization switching device disposed between said array of light-emitting elements and said photosensitive medium, for selectably transmitting light polarized in one plane among said first plane and said second plane, responsive to an electrical signal wherein said polarization switching device includes:

a polarizer, disposed between said birefringent plate and said photosensitive element for transmitting light polarized in one plane among said first plane said second plane and, a ferroelectric liquid crystal cell, disposed between said polarizer and said birefringent plate, for rotating a plane of polarization of light through a right angle responsive to said electrical signal.

2. The optical system of claim 1, wherein said array is linear, said light-emitting elements are disposed at a certain uniform spacing, and the dots illuminated by said light-emitting elements are aligned side-by-side at half said uniform spacing.

3. The optical system of claim 1, also comprising a lens array for focusing the light emitted by said array of light-emitting elements.

4. An optical system for directing light emitted by an array of light-emitting elements onto a photosensitive medium in an electrophotographic printer so as to enable each light-emitting element to illuminate two dots, comprising:

a polarizer disposed between said array of light-emitting elements and said photosensitive medium, for transmitting light that is polarized in a first plane, and blocking light that is polarized in a second plane perpendicular to said first plane;

a birefringent plate disposed between said array of light-emitting elements and said polarizer, for transmitting, without deflection, light that is polarized in one plane among said first plane and said second plane, and transmitting, with a deflection, light that is polarized in another plane among said first plane and said second plane; and a polarization rotation switch, disposed between said polarizer and said birefringent plate and includes:

a pair of glass substrates, disposed facing each other, a ferroelectric liquid crystal confined between said pair of glass substrates, and a pair of transparent electrodes disposed on facing surfaces of the respective glass substrates, for creating an electrical field with a polarity responsive to an electrical signal having two states, said polarization rotation switch rotating a plane of polarization of light through a right angle responsive to a selected state of the electrical signal, so that when said electrical signal is in one of said two states, light entering said polarization rotation switch polarized in said first plane emerges polarized in said second plane and light entering said polarization rotation switch polarized in said second plane emerges polarized in said first plane, and when said electrical signal is in another of said two states, light entering said polarization rotation switch polarized in said first plane emerges polarized in said first plane and light entering said polarization rotation switch polarized in said second plane emerges polarized in said second plane.

5. The optical system of claim 4, wherein said array is linear, said light-emitting elements are disposed at a certain uniform spacing, and the dots illuminated by said light-emitting elements are aligned side-by-side at half said uniform spacing.

6. The optical system of claim 4, comprising a lens array disposed between said polarizer and said polarization rotation switch, for focusing the light emitted by said array of light-emitting elements.

7. The optical system of claim 4, comprising a lens array disposed between said birefringent plate and said polarization rotation switch, for focusing the light emitted by said array of light-emitting elements.

8. The optical system of claim 4, comprising a lens array disposed between said array of light-emitting elements and said birefringent plate, for focusing the light emitted by said array of light-emitting elements.

9. The optical system of claim 4, comprising a lens array disposed between said polarizer and said photosensitive medium, for focusing the light emitted by said array of light-emitting elements.

10. An optical system for focusing light emitted by an array of light-emitting elements onto a photosensitive medium in an electrophotographic printer so as to enable each light-emitting element to illuminate two dots, comprising:

a polarization switch, for receiving an electrical signal having two states, includes:

a pair of glass substrates, disposed facing each other, a ferroelectric liquid crystal confined between said pair of glass substrates, a dichroic dye mixed with said ferroelectric liquid crystal, and a pair of transparent electrodes disposed on facing surfaces of the respective glass substrates, for creating an electrical field with a polarity responsive to an electrical signal having two states applied across said transparent electrodes, said polarization switch transmitting light that is polarized in a first plane but and blocking light that is polarized in a second plane perpendicular to said first plane when said electrical signal is in one of said two states, and blocking light that is polarized in said first plane but and transmitting light that is polarized in said second plane when said electrical signal is in another one of said two states; and a birefringent plate for transmitting, without deflection, light that is polarized in said second plane, and transmitting, with deflection in said first plane, light that is polarized in said first plane;

wherein said polarization switch is disposed between said birefringent plate and said photosensitive medium.

11. The optical system of claim 10, wherein said array is linear, said light-emitting elements are disposed at a certain uniform spacing, and the dots illuminated by said light-emitting elements are aligned side-by-side at half said uniform spacing.

12. The optical system of claim 10, comprising a lens array disposed between said array of light-emitting elements and said birefringent plate, for focusing the light emitted by said array of light-emitting elements.

13. The optical system of claim 10, comprising a lens array disposed between birefringent plate and said polarization switch, for focusing the light emitted by said array of light-emitting elements.

14. The optical system of claim 10, comprising a lens array disposed between said polarization switch and said photosensitive medium, for focusing the light emitted by said array of light-emitting elements.

15. An electrophotographic printer comprising:

an array of light emitting elements;

a photosensitive medium; and an optical system for directing light emitted by the array of light-emitting elements onto the photosensitive medium so as to enable each of the light emitting elements to illuminate two dots, wherein said optical system includes:

a birefringent plate disposed between said array of light-emitting elements and said photosensitive medium, for transmitting, without deflection, light that is polarized in a first plane, and transmitting, with deflection light that is polarized in a second plane perpendicular to said first plane, and a polarization switching device disposed between said birefringent plate and said photosensitive medium, for selectably transmitting light that is polarized in a one plane among said first plane and said second plane, said polarization switching device including a ferroelectric liquid crystal cell having a dichroic dye with an absorption axis that can be switched between directions parallel to said first plane and parallel to said second plane responsive to an electrical signal.

16. The electrophotographic printer of claim 15, wherein said array is linear, said light-emitting elements are disposed at a certain uniform spacing, and the dots illuminated by said light-emitting elements are aligned side-by-side at half said uniform spacing.

17. The electrophotographic printer of claim 15, further comprising a lens array for focusing the light emitted by said array of light-emitting elements.

* * * * *